US011608221B2

(12) United States Patent
Lee et al.

(10) Patent No.: US 11,608,221 B2
(45) Date of Patent: Mar. 21, 2023

(54) SHIPPING SYSTEM FOR STORING AND/OR TRANSPORTING TEMPERATURE-SENSITIVE MATERIALS

(71) Applicant: Cold Chain Technologies, LLC, Franklin, MA (US)

(72) Inventors: Tzeho Lee, Needham, MA (US); Benny Joe Ledford, Jr., Oxford, MA (US); Brian Paul Skocypec, North Attleboro, MA (US); Joseph F. Consiglio, Ashland, MA (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 350 days.

(21) Appl. No.: 16/441,833

(22) Filed: Jun. 14, 2019

(65) Prior Publication Data

US 2020/0002075 A1 Jan. 2, 2020

Related U.S. Application Data

(60) Provisional application No. 62/688,760, filed on Jun. 22, 2018, provisional application No. 62/685,720, filed on Jun. 15, 2018.

(51) Int. Cl.
*B65D 81/18* (2006.01)
*B65D 77/06* (2006.01)
(Continued)

(52) U.S. Cl.
CPC ..... *B65D 81/18* (2013.01); *B65D 77/06* (2013.01); *B65D 81/3818* (2013.01); *B65D 81/3823* (2013.01); *F25D 3/00* (2013.01)

(58) Field of Classification Search
CPC ..... B65D 81/18; B65D 81/3818; B65D 81/3823; B65D 81/3816; B65D 81/3834;
(Continued)

(56) References Cited

U.S. PATENT DOCUMENTS 2,024,397 A 12/1935 Snyder
2,031,254 A 2/1936 Derr
(Continued)

FOREIGN PATENT DOCUMENTS

BE 1009382 A3 3/1997
BE 1019423 A3 7/2012
(Continued)

OTHER PUBLICATIONS

International Search Report dated Oct. 3, 2019, from PCT Application No. PCT/US19/37333, the corresponding PCT application to the present application.
(Continued)

*Primary Examiner* — Emmanuel E Duke
(74) *Attorney, Agent, or Firm* — Kriegsman & Kriegsman

(57) ABSTRACT

Shipping systems for temperature-sensitive materials and methods of making and using same. In one embodiment, the shipping system includes a cooler base and a lid. The base includes an inner portion and an outer portion. The inner portion includes a thermal insulation unit including a bottom wall and four side walls. A thermally-conductive member is positioned on the bottom wall. A polymeric bag encapsulates the thermally-conductive member and some of the thermal insulation unit. The outer portion includes thermally-insulating material and defines an opening. The inner portion is permanently bonded to the outer portion, with cavities defined therebetween. A product box is placed in the inner portion directly over the polymeric bag and the underlying thermally-conductive member. First temperature-control members are disposed within the inner portion, with at least one temperature-control member directly over the polymeric bag and the underlying thermally-conductive member. Second temperature-control members are disposed within the cavities.

36 Claims, 23 Drawing Sheets

(51) Int. Cl.
*F25D 3/00* (2006.01)
*B65D 81/38* (2006.01)

(58) Field of Classification Search
CPC .... B65D 81/3888; B65D 81/38; B65D 77/02; F25D 2303/0844; F25D 3/06; F25D 3/08; B32B 5/18; B32B 27/36; A45C 13/02; G06Q 10/08; C09K 5/047
See application file for complete search history.

(56) References Cited

U.S. PATENT DOCUMENTS 2,045,627 A 6/1936 Wooll
RE20,215 E 12/1936 Wooll
2,322,345 A 6/1943 Cage
2,717,114 A 9/1955 Parham, Jr.
2,766,921 A 10/1956 Jones et al.
2,930,707 A 3/1960 Linnell et al.
3,236,206 A 2/1966 Willinger
3,512,696 A 5/1970 Ebert
3,889,743 A 6/1975 Presnick
3,974,658 A 8/1976 Starrett
3,993,811 A 11/1976 Walles
4,145,895 A 3/1979 Hjertstrand et al.
4,407,133 A 10/1983 Edmonson
4,576,017 A 3/1986 Combs et al.
4,682,708 A 7/1987 Pool
4,745,015 A 5/1988 Cheng et al.
4,862,674 A 9/1989 Lejondahl et al.
4,928,847 A 5/1990 Hollander et al.
5,000,372 A 3/1991 Hollander et al.
5,024,865 A 6/1991 Insely
5,050,387 A 9/1991 Bruce
5,082,335 A 1/1992 Cur et al.
5,102,004 A 4/1992 Hollander et al.
5,111,957 A 5/1992 Hollander et al.
5,230,941 A 7/1993 Hollander et al.
5,237,838 A 8/1993 Merritt-Munson
5,252,408 A 10/1993 Bridges et al.
5,269,149 A 12/1993 Zeidler
5,270,550 A 12/1993 Martorana et al.
5,314,087 A 5/1994 Shea
5,417,082 A 5/1995 Foster et al.
5,435,142 A 7/1995 Silber
5,450,977 A 9/1995 Moe
5,492,267 A 2/1996 Hollander et al.
5,501,338 A 3/1996 Preston
5,638,979 A 6/1997 Shea
5,647,226 A 7/1997 Scaringe et al.
5,669,233 A 9/1997 Cook et al.
5,671,611 A 9/1997 Quigley
5,709,307 A 1/1998 Rosado et al.
5,770,295 A 6/1998 Alderman
5,897,017 A 4/1999 Lantz
5,899,088 A 5/1999 Purdum
5,924,302 A 7/1999 Derifield
5,934,099 A 8/1999 Cook et al.
5,976,400 A 11/1999 Muffett et al.
5,979,693 A 11/1999 Bane, III
6,003,719 A 12/1999 Stewart, III
6,037,033 A 3/2000 Hunter
6,044,650 A 4/2000 Cook et al.
6,048,099 A 4/2000 Muffett et al.
6,055,825 A 5/2000 Choy
6,070,427 A 6/2000 Fine et al.
6,079,404 A 6/2000 Salyer
6,106,449 A 8/2000 Wynne
6,116,042 A 9/2000 Purdum
6,158,227 A 12/2000 Seeley
6,158,277 A 12/2000 Seeley
6,192,703 B1 2/2001 Salyer et al.
6,209,343 B1 4/2001 Owen
6,212,901 B1 4/2001 Pint et al.
6,223,551 B1 5/2001 Mitchell
6,244,458 B1 6/2001 Frysinger et al.
6,257,764 B1 7/2001 Lantz
6,260,360 B1 7/2001 Wheeler
6,349,559 B1 2/2002 Hasanovic
6,377,755 B1 4/2002 Chamberlain et al.
6,381,981 B1 5/2002 Yaddgo et al.
6,401,461 B1 6/2002 Harrison et al.
6,412,545 B1 7/2002 Buff et al.
6,482,332 B1 11/2002 Malach
6,505,479 B2 1/2003 Defelice et al.
6,513,703 B2 2/2003 Becker
6,513,974 B2 2/2003 Malone et al.
6,543,491 B1 4/2003 Chung
6,559,096 B1 5/2003 Smith et al.
6,584,797 B1 7/2003 Smith et al.
6,645,598 B2 11/2003 Alderman
6,652,771 B2 11/2003 Carn
6,666,032 B1 * 12/2003 Rickson ..... A61J 1/165 62/3.6
6,675,605 B2 1/2004 Douglas-Hamilton
6,688,132 B2 2/2004 Smith et al.
6,701,724 B2 3/2004 Smith et al.
6,718,776 B2 4/2004 Wessling et al.
6,751,963 B2 6/2004 Navedo et al.
6,773,425 B1 8/2004 Tamari
6,822,198 B2 11/2004 Rix
6,834,159 B1 12/2004 Schramm
6,858,068 B2 2/2005 Smith et al.
6,863,949 B2 3/2005 Ehrmanntraut
6,868,982 B2 3/2005 Gordon
6,875,486 B2 4/2005 Miller
6,841,209 B2 11/2005 Legare
6,968,711 B2 11/2005 Smith et al.
7,094,192 B2 8/2006 Schoenberger et al.
7,147,626 B2 12/2006 Goodman et al.
7,225,632 B2 6/2007 Derifield
7,229,677 B2 6/2007 Miller
7,240,513 B1 7/2007 Conforti
7,257,963 B2 8/2007 Mayer
7,266,949 B2 9/2007 Jeuch et al.
7,310,967 B2 12/2007 Aragon
7,318,535 B2 1/2008 Gano, III et al.
7,328,583 B2 2/2008 Hillman et al.
7,412,846 B2 8/2008 Sekiya et al.
7,422,143 B2 9/2008 Mayer
7,449,227 B2 11/2008 Echigoya et al.
7,500,593 B2 3/2009 Mayer
7,516,600 B1 4/2009 Flora
7,641,812 B2 1/2010 Alderman
7,677,406 B2 3/2010 Maxson
7,682,654 B2 3/2010 Cooper et al.
7,704,584 B2 4/2010 Alderman
7,721,566 B1 5/2010 Wilken
7,784,301 B2 8/2010 Sasaki et al.
7,849,708 B2 12/2010 Goncharko et al.
7,905,075 B2 3/2011 Flora
7,908,870 B2 3/2011 Williams et al.
7,919,163 B2 4/2011 Romero
7,935,410 B2 5/2011 Orologio
7,950,246 B1 5/2011 Mayer et al.
7,975,905 B2 7/2011 Humphries et al.
8,056,357 B2 11/2011 Bruce
8,074,465 B2 * 12/2011 Heroux ..... A01N 1/0273 62/371
8,152,367 B2 4/2012 Roberts et al.
8,156,703 B2 4/2012 Alderman
8,250,882 B2 8/2012 Mustafa et al.
8,281,558 B2 10/2012 Hiemeyer et al.
8,292,119 B2 10/2012 Kenneally
8,349,552 B2 1/2013 Haarmann et al.
8,424,335 B2 * 4/2013 Corder ..... A61J 1/165 62/371
8,443,623 B2 5/2013 Matta et al.
8,539,790 B1 9/2013 Budd
8,541,094 B2 9/2013 Miller
8,600,903 B2 12/2013 Eller
8,603,598 B2 12/2013 Hyde et al.
8,607,581 B2 12/2013 Williams et al.
8,613,202 B2 * 12/2013 Williams ..... B65D 81/3862 62/60

(56) References Cited

U.S. PATENT DOCUMENTS 8,763,423 B2 7/2014 Tattam
8,763,811 B2 7/2014 Lantz
8,763,886 B2 7/2014 Hall
8,822,005 B2 9/2014 Hiemeyer et al.
8,887,515 B2 11/2014 Patstone
8,904,810 B2 12/2014 Schabron et al.
8,938,986 B2 * 1/2015 Matta ..... F25D 3/06 62/371
9,022,249 B2 5/2015 Ranade
9,045,278 B2 6/2015 Mustafa et al.
9,060,508 B2 6/2015 Anti et al.
9,066,613 B2 6/2015 Kelly
9,090,392 B2 7/2015 Loeschen et al.
9,132,604 B2 9/2015 Chalve
9,133,973 B2 9/2015 Smith
9,139,319 B2 9/2015 Crespo et al.
9,151,531 B2 10/2015 Wengreen et al.
9,180,998 B2 * 11/2015 Banks ..... B65D 19/02
9,267,722 B2 2/2016 Blezard et al.
9,284,088 B2 3/2016 Humphries et al.
9,366,469 B2 * 6/2016 Chapman, Jr. ..... F25D 3/08
9,376,605 B2 6/2016 Matta et al.
9,429,350 B2 8/2016 Chapman, Jr.
9,556,373 B2 1/2017 Formato et al.
9,581,374 B2 2/2017 Kuhn et al.
9,598,622 B2 3/2017 Formato et al.
9,689,602 B2 6/2017 Emond et al.
9,707,156 B2 7/2017 Wengreen et al.
9,738,420 B2 8/2017 Miller
9,814,651 B2 11/2017 Wengreen et al.
9,877,894 B2 1/2018 Wengreen et al.
9,913,777 B2 3/2018 Wengreen et al.
9,944,449 B2 4/2018 Wood et al.
9,956,140 B2 5/2018 Wengreen et al.
9,957,099 B2 5/2018 White et al.
10,077,389 B2 9/2018 Formate et al.
10,309,709 B2 6/2019 Emond et al.
10,583,978 B2 3/2020 Longley et al.
10,604,326 B2 3/2020 Longley et al.
10,661,969 B2 5/2020 Pranadi et al.
10,766,685 B2 9/2020 Kuhn et al.
2002/0147242 A1 10/2002 Salyer et al.
2002/0164474 A1 11/2002 Buckley
2003/0082357 A1 5/2003 Gokay et al.
2003/0102317 A1 6/2003 Gordon
2005/0118915 A1 6/2005 Heifetz
2005/0189404 A1 9/2005 Xiaohai et al.
2005/0224501 A1 * 10/2005 Folkert ..... B65D 81/386 220/592.2
2007/0028642 A1 2/2007 Glade et al.
2007/0186577 A1 8/2007 Goncharko
2007/0193297 A1 8/2007 Wilson
2007/0295733 A1 12/2007 Balva et al.
2008/0014435 A1 1/2008 Smith et al.
2008/0022696 A1 1/2008 Welle et al.
2008/0099492 A1 5/2008 Mayer
2009/0000312 A1 1/2009 Smith et al.
2009/0078699 A1 * 3/2009 Mustafa ..... B65D 81/3862 220/1.5
2010/0018978 A1 1/2010 Osborne
2010/0314397 A1 12/2010 Williams et al.
2011/0030415 A1 2/2011 Breyburg et al.
2011/0100868 A1 5/2011 Lantz
2011/0155621 A1 6/2011 Lindquist et al.
2011/0248038 A1 10/2011 Mayer
2011/0290792 A1 12/2011 Krzak et al.
2012/0072046 A1 3/2012 Tattam
2012/0243808 A1 9/2012 de Lesseux et al.
2012/0279896 A1 11/2012 Lantz
2012/0318808 A1 12/2012 McCormick
2013/0055750 A1 3/2013 Mustafa et al.
2013/0062355 A1 3/2013 Shulman
2013/0228583 A1 * 9/2013 Mayer ..... B65D 21/0223 220/592.27
2013/0255306 A1 10/2013 Mayer
2014/0008042 A1 1/2014 Schryver et al.
2014/0054297 A1 * 2/2014 Patstone ..... F25D 3/08 220/592.01
2014/0130526 A1 5/2014 Kerkmans
2014/0151382 A1 * 6/2014 White ..... B65D 81/3862 220/592.2
2014/0174692 A1 6/2014 Emond et al.
2014/0196305 A1 7/2014 Smith
2014/0343493 A1 11/2014 Wengreen
2014/0360044 A1 12/2014 Smith
2015/0068242 A1 3/2015 Patstone
2015/0158656 A1 6/2015 McKinnon
2015/0166244 A1 6/2015 Wood et al.
2015/0191291 A1 * 7/2015 Wood ..... B65D 81/18 220/592.1
2015/0274415 A1 10/2015 Farrar et al.
2015/0285548 A1 10/2015 Emond et al.
2016/0243000 A1 8/2016 Gray
2016/0262979 A1 9/2016 Wengreen et al.
2017/0082344 A1 3/2017 Tansley
2018/0036202 A1 2/2018 Wengreen et al.
2018/0093816 A1 4/2018 Longley et al.
2018/0100682 A1 4/2018 Nilsen et al.
2018/0320947 A1 * 11/2018 Jain ..... F25D 3/06
2018/0328644 A1 11/2018 Rizzo et al.
2019/0085226 A1 3/2019 Formato et al.
2019/0210790 A1 7/2019 Rizzo et al.
2019/0285328 A1 9/2019 Emond et al.
2020/0231362 A1 7/2020 Kulangara et al.
2021/0070539 A1 3/2021 Chasteen et al.

FOREIGN PATENT DOCUMENTS

CA 2824817 A1 2/2015
CN 201457996 U 5/2010
CN 201581575 U 9/2010
CN 201721778 U 1/2011
CN 103640804 A 3/2014
DE 10148587 C1 11/2002
DE 202011050514 U8 3/2012
EP 0157751 A2 10/1985
EP 750732 B1 8/1999
EP 1006058 A1 6/2000
EP 1336574 A2 8/2003
EP 1110043 B1 11/2004
EP 1780147 A1 5/2007
EP 2374443 B1 1/2014
EP 3128266 A1 2/2017
FR 993538 A 11/1951
FR 1111645 A1 3/1956
FR 2518504 A1 6/1983
FR 2535691 A1 5/1984
FR 2832133 A1 5/2003
FR 2833074 B1 1/2004
FR 2847237 B1 8/2005
FR 2948342 A1 1/2011
GB 908002 A 10/1962
GB 1338554 A 11/1973
GB 2336899 A 11/1999
GB 2383122 A 6/2003
GB 2383402 A 6/2003
JP 3271943 B2 4/2002
JP 2004238051 A 8/2004
JP 2006011585 A 1/2006
JP 2006232331 A 9/2006
JP 4225157 B2 2/2009
JP 2009149380 A 7/2009
JP 4903831 B2 3/2012
KR 200249267 Y1 11/2001
KR 101519521 B1 5/2015
WO 8702122 A1 4/1987
WO 2003073030 A1 9/2003
WO 2006012074 A2 2/2006
WO 2006095038 A2 9/2006
WO 2007042248 A1 4/2007
WO 2008133374 A1 11/2008
WO 2011023996 A2 3/2011
WO 2014100826 A1 6/2014
WO 2015153607 A1 10/2015

(56) References Cited

FOREIGN PATENT DOCUMENTS

| | | | |
|---|---|---|---|
| WO | 2016177523 | A1 | 11/2016 |
| WO | 2017048793 | A1 | 3/2017 |
| WO | 2017072638 | A1 | 5/2017 |
| WO | 2018213348 | A2 | 11/2018 |

OTHER PUBLICATIONS

Written Opinion dated Oct. 3, 2019, from PCT Application No. PCT/US19/37333, the corresponding PCT application to the present application.
"InsulTote® Insulated Packaging Supplies," Inovative Energy, Inc., Insultote.net, accessed: Feb. 2016. http://insultote.net/insulatedpackaging.php.
"Temperature Control Packaging," IPC, ipcpack.com, accessed: Feb. 2016. http://www.ipcpack.com/products/temperature-control-packaging/.
"Shipping Products," rFOIL™, rfoil.com, accessed: Feb. 2016. http://www.rfoil.com/products-sp.shtml.
"Temperature Packaging," Miller Supply, Inc., millersupplyinc.com, accessed: Feb. 2016. http://www.millersupplyinc.com/boxes/temperature-packaging-c-2_2898.html.
"Cool Blue™ Insulated Foil Bubble Box Liners (Box Inserts)," Nortech Labs, nortechlabs.com, accessed: Feb. 2016. http://www.nortechlabs.com/insulated-box-liners.html.
"Reflect-A-Cool—Heat Reflective Sheets," DEI Power Sports, deipowersports.com, 2014. https://www.deipowersports.com/products/thermal-barriers/reflect-a-cool.
Pack-out Sheet for KoolTemp GTS Excel 12L, +2° C. to 8° C., Universal Packout, Cold Chain Technologies, Franklin, MA (2013).
Pack-out Sheet for KoolTemp GTS Extreme 7L, +2° C. to 8° C., Universal Packout, Cold Chain Technologies, Franklin, MA (2014).
Pack-out Sheet for KoolTemp GTS Extreme 15L, +2° C. to 8° C., Universal Packout, Cold Chain Technologies, Franklin, MA (2014).
Pack-out Sheet for KoolTemp GTS Extreme 30L, +2° C. to 8° C., Universal Packout, Cold Chain Technologies, Franklin, MA (2014).
Pack-out Sheet for KoolTemp GTS Extreme 40L, +2° C. to 8° C., Universal Pack-out, Cold Chain Technologies, Franklin, MA (2015).
Pack-out Sheet for KoolTemp GTS Extreme 45L, +2° C. to 8° C., Universal Packout, Cold Chain Technologies, Franklin, MA (2014).
Pack-out Sheet for KoolTemp GTS Extreme 45L, Frozen, Universal Packout, Cold Chain Technologies, Franklin, MA (2015).
Singh et al., "Performance Comparison of Thermal Insulated Packaging Boxes, Bags and Refrigerants for Single-parcel Shipments," Packaging Technology and Science 21: 25-35 (2008).
ElFantastic0, "Make a well-insulated travel cooler," instructables, instructables.com (2016). http://web.archive.org/web/20161019021006/http://www.instructables.com:80/id/Makeawellinsulatedtravelcooler/.
"Insulated Shipping Box Liners," Innovative Energy, Inc., insultote.net (2014). http://web.archive.org/web/20140709090405/http://www.insultote.net/insulatedboxliners.php.
"Lower-Impact Packaging and Shipping," Thermo Fisher Scientific, thermofisher.com (2016). https://webbeta.archive.org/web/20160710092816/http://www.thermofisher.com:80/us/en/home/aboutus/productstewardship/ambientshipping.html.
"Foil Bubble Insulating Bags Covers." Bee Packaging, beepacking.com (2017). https://www.beepackaging.com/foilbubble/.
"Reflective Solutions." KodiaKooler®, kodiakooler.com (2017). https://kodiakooler.com/products/kodiakoolerreflectiveproducts.
U.S. Appl. No. 16/246,435, inventors James Robert Chasteen et al., filed Jan. 11, 2019.
U.S. Appl. No. 16/457,871, inventor Peter Martino, filed Jun. 28, 2019.
U.S. Appl. No. 16/936,188, inventor Iman Mirzaee Kakhki, filed Jul. 22, 2020.
Formato, "The Advantages & Challenges of Phase Change Materials (PCMs) in Thermal Packaging," Cold Chain Technologies, coldchaintech.com,accessed: Jun. 2017.
"SavEnrg™ Temperature Controlled Packaging," SavEnrg™, rgees.com, accessed: Jun. 2017.
"Insulated Shipping Containers," NanoPore, nanopore.com, 2008. http://www.nanopore.com/shipping.html.
"Phase Change Materials: Temperature control for wine shipping containers," RGEES, LLC, phasechangematerials.blogspot.com, Jul. 13, 2012.http://phasechangematerials.blogspot.com/2012/07/temperature-control-for-wine-shipping.html.
Abstract of Shrivastava, Saurabh, and Bahgat Sammakia, "Thermal management of biomaterials in a rectangular cavity surrounded by a phase change material," Thermal and Thermomechanical Phenomena in Electronic Systems, 2004.ITHERM'04, The Ninth Intersociety Conference, vol. 1, IEEE, 2004.http://ieeexplore.ieee.org/document/1319162/.

* cited by examiner

SECTION A-A

SECTION B-B

SHIPPING SYSTEM FOR STORING AND/OR TRANSPORTING TEMPERATURE-SENSITIVE MATERIALS

CROSS-REFERENCE TO RELATED APPLICATIONS

The present application claims the benefit under 35 U.S.C. 119(e) of U.S. Provisional Patent Application No. 62/685,720, inventors TzeHo Lee et al., filed Jun. 15, 2018, and U.S. Provisional Patent Application No. 62/688,760 inventors TzeHo Lee et al., filed Jun. 22, 2018, the disclosures of both of which are incorporated herein by reference.

BACKGROUND OF THE INVENTION

The present invention relates generally to shipping systems for storing and/or transporting temperature-sensitive materials and relates more particularly to a novel such shipping system.

It is often desirable to store and/or to transport temperature-sensitive materials, examples of such materials including, but not being limited to, pharmaceuticals, biological samples, medical devices, foods, and beverages. As a result, various types of shipping systems for storing and/or transporting such materials have been devised, some of these shipping systems being parcel-sized shipping systems and some of these shipping systems being pallet-sized shipping systems. Typically, such parcel-sized shipping systems include an insulated container having a cavity for receiving a temperature-sensitive material. Often, the temperature-sensitive material is housed within a product or payload container, the product or payload container (with the temperature-sensitive material disposed therewithin) being placed in the cavity of the insulated container. Such shipping systems often also include a phase-change material disposed within the insulated container for maintaining the temperature-sensitive material within a desired temperature range. In many instances, such as when the desired temperature range for the temperature-sensitive material is below the ambient temperature outside the insulated container, the phase-change material is refrigerated or frozen prior to being placed in the insulated container so that the phase-change material can act as a coolant.

An example of a parcel-sized shipping system of the type described above is illustrated by U.S. Pat. No. 6,868,982, inventor Gordon, which issued, Mar. 22, 2005, and which is incorporated herein by reference. According to this patent, there is disclosed an insulated shipping container and a method of making the same. In a preferred embodiment, the insulated shipping container comprises an outer box, an insulated insert, an inner box, and a closure member. The outer box, which is preferably made of corrugated fiberboard, comprises a rectangular prismatic cavity bounded by a plurality of rectangular side walls, a closed bottom end, and top closure flaps. The insulated insert is snugly, but removably, disposed within the outer box and is shaped to define a rectangular prismatic cavity bounded by a bottom wall and a plurality of rectangular side walls, the insulated insert having an open top end. The insulated insert is made of a foamed polyurethane body to which on all sides, except its bottom, a thin, flexible, unfoamed polymer bag is integrally bonded. The bag is a unitary structure having a generally uniform rectangular shape, the bag being formed by sealing shut one end of a tubular member with a transverse seam and forming longitudinal creases extending from opposite ends of the seam. The inner box, which is snugly, but removably, disposed within the insert, is preferably made of corrugated fiberboard and is shaped to include a rectangular prismatic cavity bounded by a plurality of rectangular side walls and a closed bottom end, the top end thereof being open. The closure member is a thick piece of foam material snugly, but removably, disposed in the open end of the inner box. In use, a temperature sensitive material is placed in the inner box, together with dry ice or some other temperature-stabilizing material.

Another example of a parcel-sized shipping system of the type described above is illustrated by U.S. Pat. No. 9,045,278, inventors Mustafa et al., which issued Jun. 2, 2015, and which is incorporated herein by reference. According to this patent, there is disclosed an insulated shipping container and method of making the same. In a preferred embodiment, the aforementioned shipping container includes an outer box, an insulated insert, an insulated cover, a payload container and a plurality of coolant members. The insulated insert is snugly, but removably, disposed within the outer box and is shaped to include a plurality of sides and a top. The top includes a raised peripheral edge and a recessed shelf. A large rectangular prismatic cavity surrounded by a plurality of smaller cavities extends downwardly from the recessed shelf. The large cavity of the insulated insert is adapted to receive a payload container. Each of the smaller cavities of the insulated insert is adapted to receive a coolant member, the smaller cavities having a "top hat" shape when viewed from above that includes a crown portion and a brim portion.

Other documents of interest may include the following, all of which are incorporated herein by reference: U.S. Pat. No. 8,250,882, inventors Mustafa et al., issued Aug. 28, 2012; U.S. Pat. No. 5,897,017, inventor Lantz, issued Apr. 27, 1999; U.S. Pat. No. 6,257,764, inventor Lantz, issued Jul. 10, 2001; U.S. Pat. No. 5,924,302, inventor Derifield, issued Jul. 20, 1999; U.S. Pat. No. 6,044,650, inventors Cook et al., issued Apr. 4, 2000; U.S. Pat. No. 5,709,307, inventors Rosado et al., issued Jan. 20, 1998; U.S. Pat. No. 5,450,977, inventor Moe, issued Sep. 19, 1995; U.S. Pat. No. 5,501,338, inventor Preston, issued Mar. 26, 1996; U.S. Pat. No. 6,244,458, inventors Frysinger et al., issued Jun. 12, 2001; U.S. Pat. No. 6,192,703, inventors Salyer et al., issued Feb. 27, 2001; U.S. Pat. No. 7,950,246, inventors Mayer et al., issued May 31, 2011; U.S. Patent Appln. Publication No. US 2005/0224501 A1, inventors Folkert et al., published Oct. 13, 2005; and U.S. Patent Appln. Publication No. US 2003/0102317 A1, inventor Gordon, published Jun. 5, 2003.

SUMMARY OF THE INVENTION

It is an object of the present invention to provide a novel shipping system for storing and/or transporting temperature-sensitive materials.

According to one aspect of the invention, there is provided a shipping system for use in transporting and/or storing temperature-sensitive materials, the shipping system comprising (a) a cooler base, the cooler base comprising (i) an inner portion, the inner portion comprising (A) a thermal insulation unit, the thermal insulation unit comprising a bottom wall and four side walls, the bottom wall and the four side walls collectively defining a chamber, (B) a thermally-conductive member, the thermally-conductive member being disposed within the chamber and over at least a portion of the bottom wall of the thermal insulation unit, and (C) a first polymeric bag, the first polymeric bag conformingly disposed over the thermally-conductive member and at least a portion of the thermal insulation unit, (ii) an outer portion, the outer portion comprising thermally-insulating material and defining an opening, wherein the inner portion is disposed within the opening of the outer portion and wherein the inner portion and the outer portion collectively define a plurality of cavities therebetween; (b) a product box, the product box disposed within the inner portion of the cooler base, the product box being in direct contact with the first polymeric bag and being positioned over a first portion of the thermally-conductive member; (c) a first set of temperature-control members, the first set of temperature-control members being disposed within the inner portion of the cooler base, wherein at least one of the first set of temperature-control members is in direct contact with the first polymer bag, is positioned over a second portion of the thermally-conductive member, and is in thermal contact with the thermally-conductive member, and wherein none of the first set of temperature-control members is positioned under the product box; and (d) a second set of temperature-control members, wherein at least one of the second set of temperature-control members is disposed within the cavities.

In a more detailed feature of the invention, the payload box may be a six-sided structure comprising a top, a bottom, and four sides, the first set of temperature-control members may comprise a plurality of temperature-control members, and the plurality of temperature-control members may collectively cover at least a portion of the top of the payload box and at least a portion of each of the four sides of the payload box.

In a more detailed feature of the invention, the first set of temperature-control members may comprise a plurality of temperature-control members, and the plurality of temperature-control members of the first set of temperature-control members may collectively comprise no more than one type of phase-change material.

In a more detailed feature of the invention, the first set of temperature-control members may comprise a plurality of temperature-control members, and the plurality of temperature-control members of the first set of temperature-control members may collectively comprise more than one type of phase-change material.

In a more detailed feature of the invention, the first set of temperature-control members may comprise a plurality of temperature-control members, and each of the plurality of temperature-control members may comprise a water-based phase-change material.

In a more detailed feature of the invention, the first set of temperature-control members may comprise a plurality of temperature-control members, and each of the plurality of temperature-control members may comprise an organic phase-change material.

In a more detailed feature of the invention, the organic phase-change material may comprise a gelled organic phase-change material comprising at least one n-alkane.

In a more detailed feature of the invention, the first set of temperature-control members may comprise a plurality of temperature-control members, and the plurality of temperature-control members of the first set of temperature-control members may be identical in size, shape and composition and may be adapted to be interchangeably positioned with one another.

In a more detailed feature of the invention, the first set of temperature-control members may comprise a plurality of temperature-control members, and each of the plurality of temperature-control members of the first set of temperature-control members may comprise a phase-change material having a phase-change temperature in the range of +2° C. to +8° C.

In a more detailed feature of the invention, the first set of temperature-control members may comprise a plurality of temperature-control members, and each of the plurality of temperature-control members of the first set of temperature-control members may comprise a phase-change material having a phase-change temperature in the range of +15° C. to +25° C.

In a more detailed feature of the invention, the first set of temperature-control members may comprise a first phase-change material, the second set of temperature-control members may comprise a second phase-change material, and the first phase-change material and the second phase-change material may be different from one another in composition.

In a more detailed feature of the invention, the second set of temperature-control members may comprise a plurality of temperature-control members, and the plurality of temperature-control members of the second set of temperature-control members may be identical in size, shape and composition and may be adapted to be interchangeably positioned with one another.

In a more detailed feature of the invention, the inner portion of the cooler base may be fixedly mounted within the outer portion of the cooler base.

In a more detailed feature of the invention, the inner portion of the cooler base may be permanently bonded with an adhesive to the outer portion of the cooler base.

In a more detailed feature of the invention, the outer portion of the cooler base may comprise a bottom wall and four side walls, the bottom wall of the outer portion of the cooler base may comprise a recessed area, and the recessed area may be dimensioned to matingly receive the inner portion of the cooler base.

In a more detailed feature of the invention, the outer portion of the cooler base may further comprise four corner posts for use in defining the cavities between the inner portion and the outer portion.

In a more detailed feature of the invention, the outer portion of the cooler base may further comprise at least one vertical rib for use in defining the cavities between the inner portion and the outer portion.

In a more detailed feature of the invention, the thermally-insulating material of the outer portion of the cooler base may comprise a body of foamed polyurethane, the outer portion of the cooler base may further comprise a second polymeric bag, and the second polymeric bag may be conformingly disposed over the body of foamed polyurethane.

In a more detailed feature of the invention, the thermal insulation unit of the inner portion of the cooler base may further comprise a pair of steps disposed at opposite ends of the bottom wall, and the thermally-conductive member may be disposed between the pair of steps.

In a more detailed feature of the invention, the thermally-conductive member may comprise an aluminum sheet having a thickness of about 10 mil.

In a more detailed feature of the invention, the shipping system may further comprise a cooler lid, and the cooler lid may be mounted on the cooler base to selectively permit access to contents of the cooler base.

In a more detailed feature of the invention, the cooler lid may comprise a plurality of different thermal insulation materials.

In a more detailed feature of the invention, the cooler lid may comprise a vacuum insulation panel embedded within foamed polyurethane.

In a more detailed feature of the invention, the first set of temperature-control members may comprise at least one temperature-control member positioned over the product box, the second set of temperature-control members may comprise at least one temperature-control member positioned over the product box and over the at least one temperature-control member of the first set of temperature-control members positioned over the product box, the shipping system may further comprise a foam pad divider positioned over the product box, and the foam pad divider may be positioned between the at least one temperature-control member of the first set of temperature-control members positioned over the product box and the at least one temperature-control member of the second set of temperature-control members positioned over the product box.

In a more detailed feature of the invention, the first set of temperature-control members may comprise a first plurality of temperature-control members, the second set of temperature-control members may comprise a second plurality of temperature-control members, each of the first plurality of temperature-control members may comprise a first phase-change material, each of the second plurality of temperature-control members may comprise a second phase-change material, and the first phase-change material and the second phase-change material may have different phase-change temperatures.

In a more detailed feature of the invention, the first set of temperature-control members may comprise a first plurality of temperature-control members, the second set of temperature-control members may comprise a second plurality of temperature-control members, and the first plurality of temperature-control members and the second plurality of temperature-control members may be preconditioned at different temperatures.

In a more detailed feature of the invention, the first set of temperature-control members may comprise a first plurality of temperature-control members, the second set of temperature-control members may comprise a second plurality of temperature-control members, and the first plurality of temperature-control members and the second plurality of temperature-control members may be preconditioned at the same temperature.

According to another aspect of the invention, there is provided a shipping system for use in transporting and/or storing temperature-sensitive materials, the shipping system comprising (a) a cooler base, the cooler base comprising (i) an inner portion, the inner portion comprising a thermal insulation unit, the thermal insulation unit comprising a bottom wall and four side walls, the bottom wall and the four side walls collectively defining a chamber, (ii) an outer portion, the outer portion comprising thermally-insulating material and defining an opening, wherein the inner portion is disposed within the opening of the outer portion and is permanently bonded to the outer portion, and wherein the inner portion and the outer portion collectively define a plurality of cavities therebetween; (b) a product box, the product box disposed within the inner portion of the cooler base and seated on the bottom wall of the inner portion, the product box having a plurality of faces; (c) a first plurality of temperature-control members, the first plurality of temperature-control members being disposed within the inner portion of the cooler base on one or more faces of the product box, wherein no temperature-control members are positioned under the product box; (d) a second plurality of temperature-control members, wherein at least some of the second plurality of temperature-control members are disposed within the cavities; and (e) a cooler lid, the cooler lid being mounted on the cooler base to selectively permit access to contents of the cooler base.

According to yet another aspect of the invention, there is provided a shipper for use in a shipping system for transporting and/or storing temperature-sensitive materials, the shipper comprising (a) a cooler base, the cooler base comprising (i) an inner portion, the inner portion comprising a thermal insulation unit, the thermal insulation unit comprising a bottom wall and four side walls, the bottom wall and the four side walls collectively defining a chamber, (ii) an outer portion, the outer portion comprising thermally-insulating material and defining an opening, wherein the inner portion is disposed within the opening of the outer portion and is permanently bonded to the outer portion, and wherein the inner portion and the outer portion collectively define a plurality of cavities therebetween; (b) a product box, the product box disposed within the inner portion of the cooler base and seated on the bottom wall of the inner portion, the product box having a plurality of faces; and (c) a cooler lid, the cooler lid being mounted on the cooler base to selectively permit access to contents of the cooler base.

In a more detailed feature of the invention, the inner portion of the cooler base may further comprise a thermally-conductive member and a first polymeric bag, the thermally-conductive member may be disposed over at least a portion of the bottom wall of the thermal insulation unit, and the first polymeric bag may be conformingly disposed over the thermally-conductive member and at least a portion of the thermal insulation unit.

According to still another aspect of the invention, there is provided a shipping system, the shipping system comprising the above-described shipper and dry ice, the dry ice being disposed in the chamber of the inner portion on top of and around the product box, but not below the product box, and also being disposed in the cavities between the inner portion and the outer portion.

According to a further aspect of the invention, there is provided a kit, the kit comprising the above-described shipper, a first set of temperature-control members comprising a first phase-change material, a second set of temperature-control members comprising a second phase-change material, and a third set of temperature-control members comprising a third phase-change material, the second phase-change material being different in composition than the first phase-change material, the third phase-change material being different in composition than the first and second phase-change materials, the first and third sets of temperature-control members being alternatively positionable in the chamber of the inner portion of the cooler base, the second set of temperature-control members being positionable in the cavities between the inner portion and the outer portion.

According to yet a further aspect of the invention, there is provided a kit, the kit comprising a plurality of the above-described shippers, wherein at least a first shipper of the plurality of shippers is dimensioned for a different payload volume than a second shipper of the plurality of shippers, a first set of temperature-control members comprising a first phase-change material and a second set of temperature-control members comprising a second phase-change material, the first set of temperature-control members being alternatively positionable in the chamber of the inner portion of the cooler base of the first shipper and in the chamber of the inner portion of the cooler base of the second shipper, the second set of temperature-control members being alternatively positionable in the cavities between the inner portion and the outer portion of the cooler base of the first shipper and in the cavities between the inner portion and the outer portion of the cooler base of the second shipper.

According to still a further aspect of the invention, there is provided a method of transporting and/or storing temperature-sensitive materials, the method comprising the steps of (a) providing the above-described shipper; (b) providing a first set of temperature-control members and a second set of temperature-control members, the first set of temperature-control members being positionable in the chamber of the inner portion of the cooler base, the second set of temperature-control members being positionable in the cavities between the inner portion and the outer portion; (c) transporting the shipper, the first set of temperature-control members and the second set of temperature-control members from a first location to a second location; (d) preconditioning the first set of temperature-control members and the second set of temperature-control members; (e) installing the first set of temperature-control members and the second set of temperature-control members in the shipper; and (f) loading a payload into the product box.

In a more detailed feature of the invention, the transporting step may comprise transporting the first set of temperature-control members and the second set of temperature-control members outside of the shipper.

In a more detailed feature of the invention, the transporting step may comprise transporting the first set of temperature-control members and the second set of temperature-control members in the shipper.

In a more detailed feature of the invention, the preconditioning step may be performed before the installing step.

According to still yet a further aspect of the invention, there is provided a method of making a shipper for use in transporting and/or storing temperature-sensitive materials, the method comprising the steps of (a) fabricating an inner portion of a cooler base, the inner portion comprising a thermal insulation unit, the thermal insulation unit comprising a bottom wall and four side walls, the bottom wall and the four side walls collectively defining a chamber, (b) fabricating an outer portion of a cooler base, the outer portion comprising thermally-insulating material and defining an opening; (c) positioning the inner portion of the cooler base within the opening of the outer portion of the cooler base and permanently bonding the inner portion of the cooler base to the outer portion of the cooler base, whereby a cooler base is formed in which the inner portion and the outer portion collectively define a plurality of cavities therebetween; (d) positioning a cooler lid on the cooler base to selectively permit access to contents of the cooler base.

In a more detailed feature of the invention, the inner portion of the cooler base may further comprise a thermally-conductive member and a first polymeric bag, the thermally-conductive member may be disposed over at least a portion of the bottom wall of the thermal insulation unit, and the first polymeric bag may be conformingly disposed over the thermally-conductive member and at least a portion of the thermal insulation unit.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts:

FIG. 3(*d*) is an enlarged fragmentary section view of the outer portion of the cooler base shown in FIG. 3(*b*) for purposes of showing the bag encasing the body;

FIG. 11(*d*) is an enlarged fragmentary section view of the outer portion of the cooler base shown in FIG. 11(*b*) for purposes of showing the bag encasing the body;

DETAILED DESCRIPTION OF THE INVENTION

Figure 1:
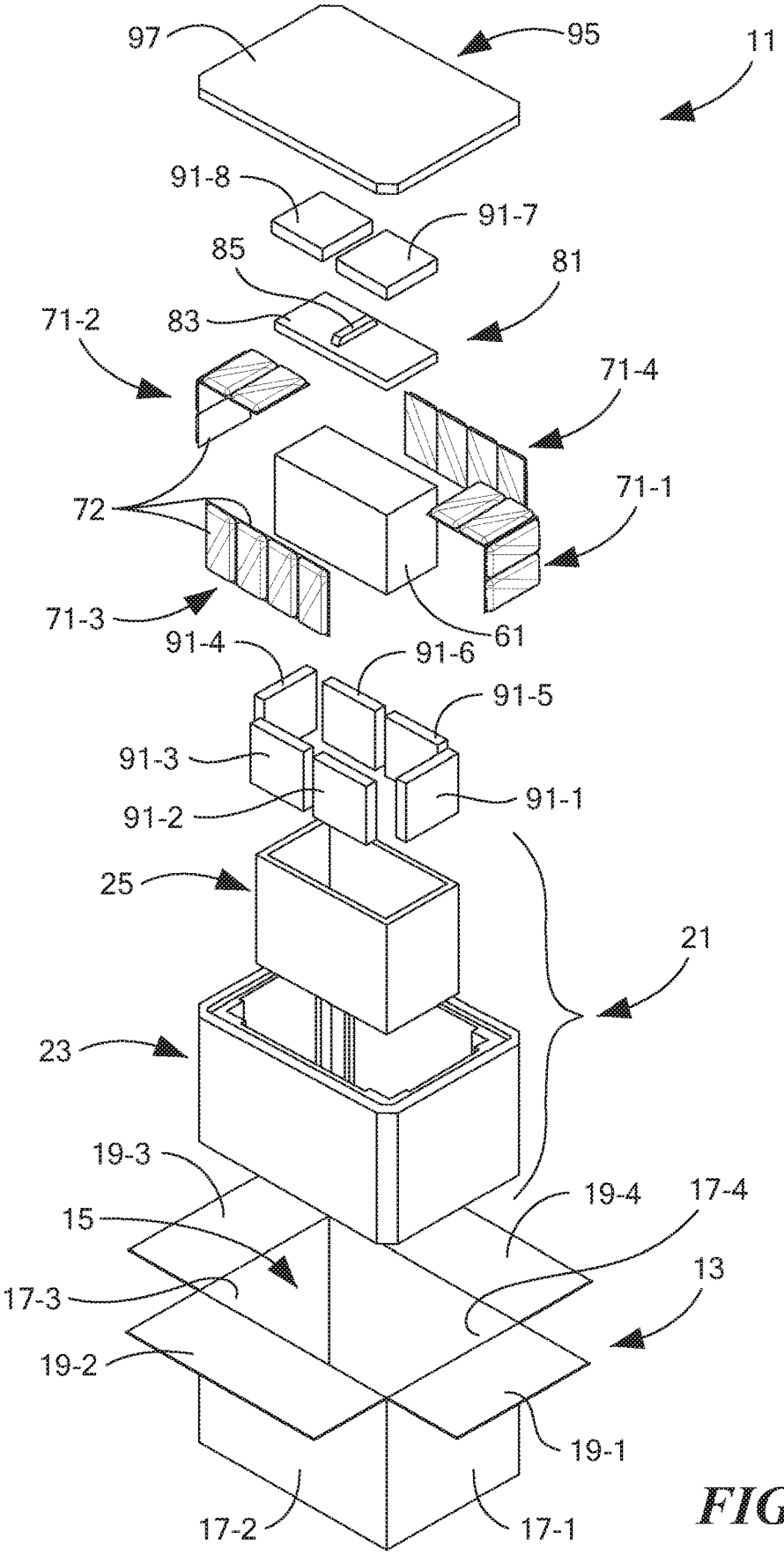
FIG. 1 is a partly exploded perspective view of a first embodiment of a shipping system suitable for use in storing and/or transporting temperature-sensitive materials, the shipping system being constructed according to the present invention.

Referring now to FIG. 1, there is shown a partly exploded perspective view of a first embodiment of a shipping system suitable for use in storing and/or transporting temperature-sensitive materials, the shipping system being constructed according to the present invention and being represented generally by reference numeral 11. For clarity and/or ease of illustration, certain details of shipping system 11 that are discussed elsewhere in this application or that are not critical to an understanding of the invention may be omitted from FIG. 1 or may be shown therein in a simplified manner.

System 11 may be used to maintain a payload within a desired temperature range for an extended period of time. Solely for illustrative purposes and not to be limited thereto, system 11 may be configured to maintain a parcel-sized payload within a temperature range of +2° C. to +8° C. for a period of up to 96 hours or longer or, alternatively, may be configured to maintain a parcel-sized payload within a temperature range of +15° C. to +25° C. for a period of up to 96 hours or longer or, alternatively, may be configured to maintain a parcel-sized payload at a temperature below −20° C. for a period of up to 96 hours or longer.

System 11 may comprise an outer box 13. Outer box 13, which may be, for example, a conventional corrugated cardboard box or carton, may comprise a rectangular prismatic cavity 15 bounded by a plurality of rectangular side walls 17-1 through 17-4 (wherein side walls 17-2 and 17-4 are larger than side walls 17-1 and 17-3), a plurality of bottom closure flaps (not shown), and a plurality of top closure flaps 19-1 through 19-4. Adhesive strips of tape or other closure means (not shown) may be used to retain, in a closed condition, the bottom closure flaps and top closure flaps 19-1 through 19-4.

Figure 2:
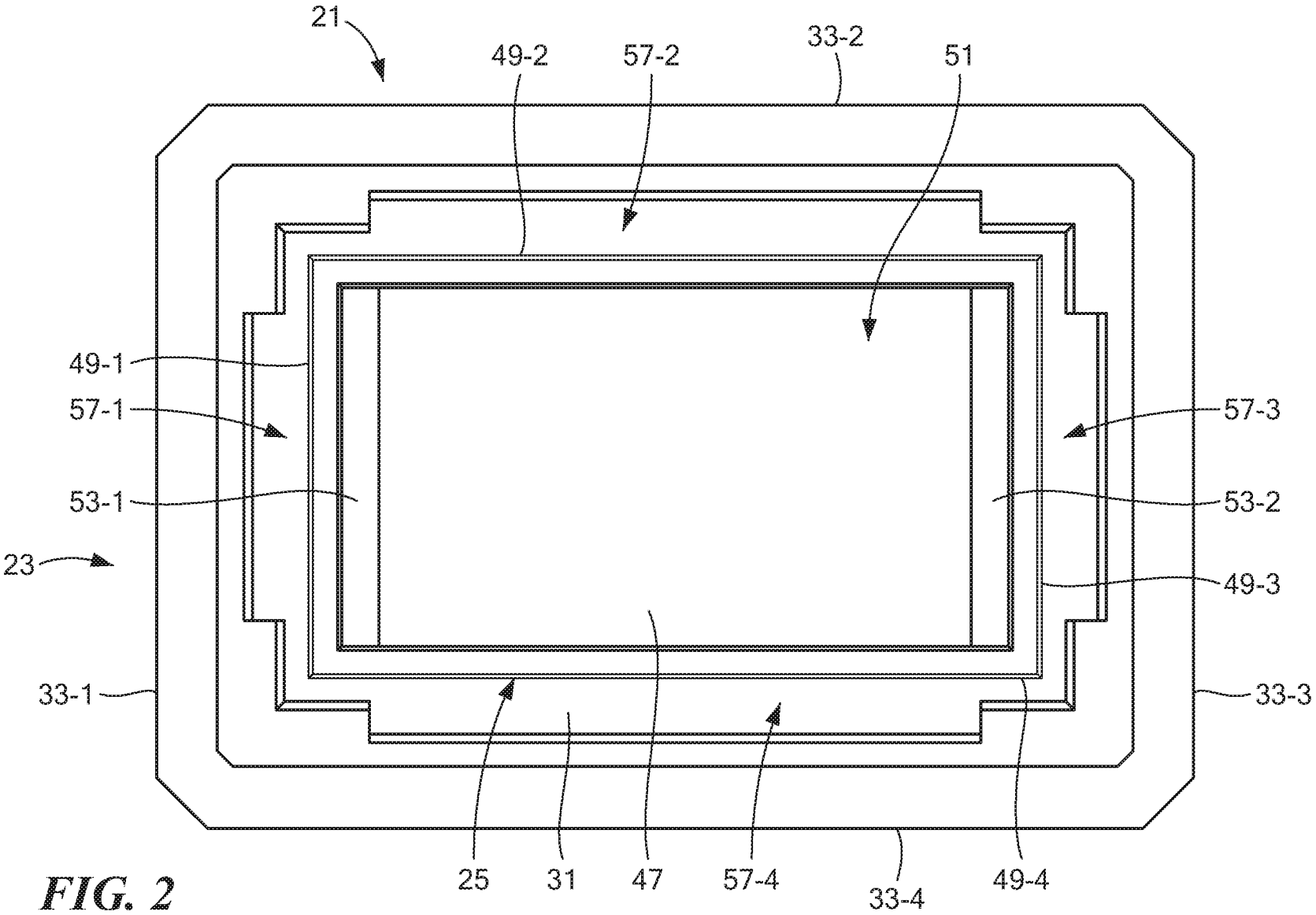
FIG. 2 is a top view of the cooler base shown in FIG. 1.
Figure 3A:
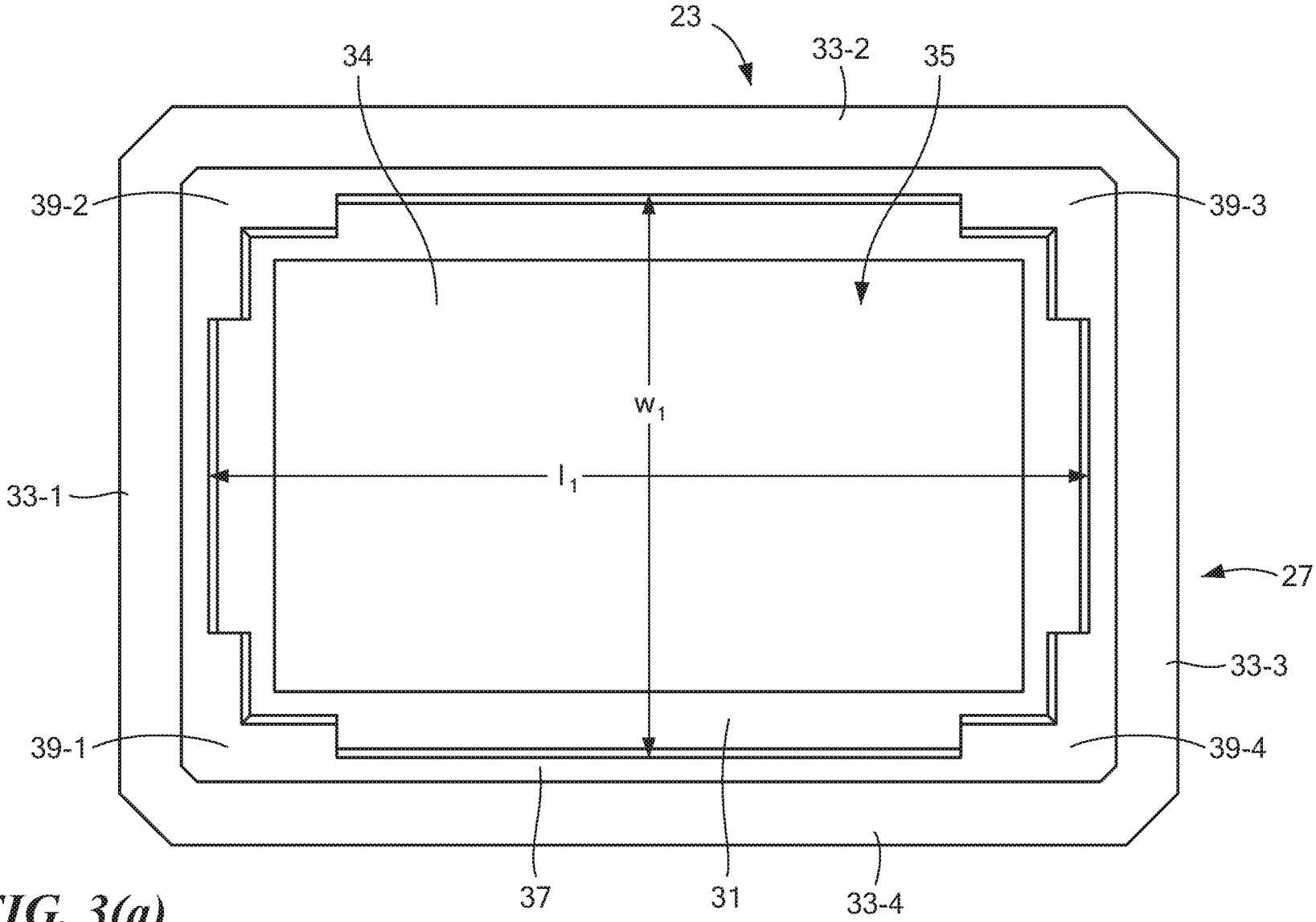
FIGS. 3(*a*) through 3(*c*) are top, longitudinal section, and lateral section views, respectively, of the outer portion of the cooler base shown in FIG. 2.
Figure 3B:
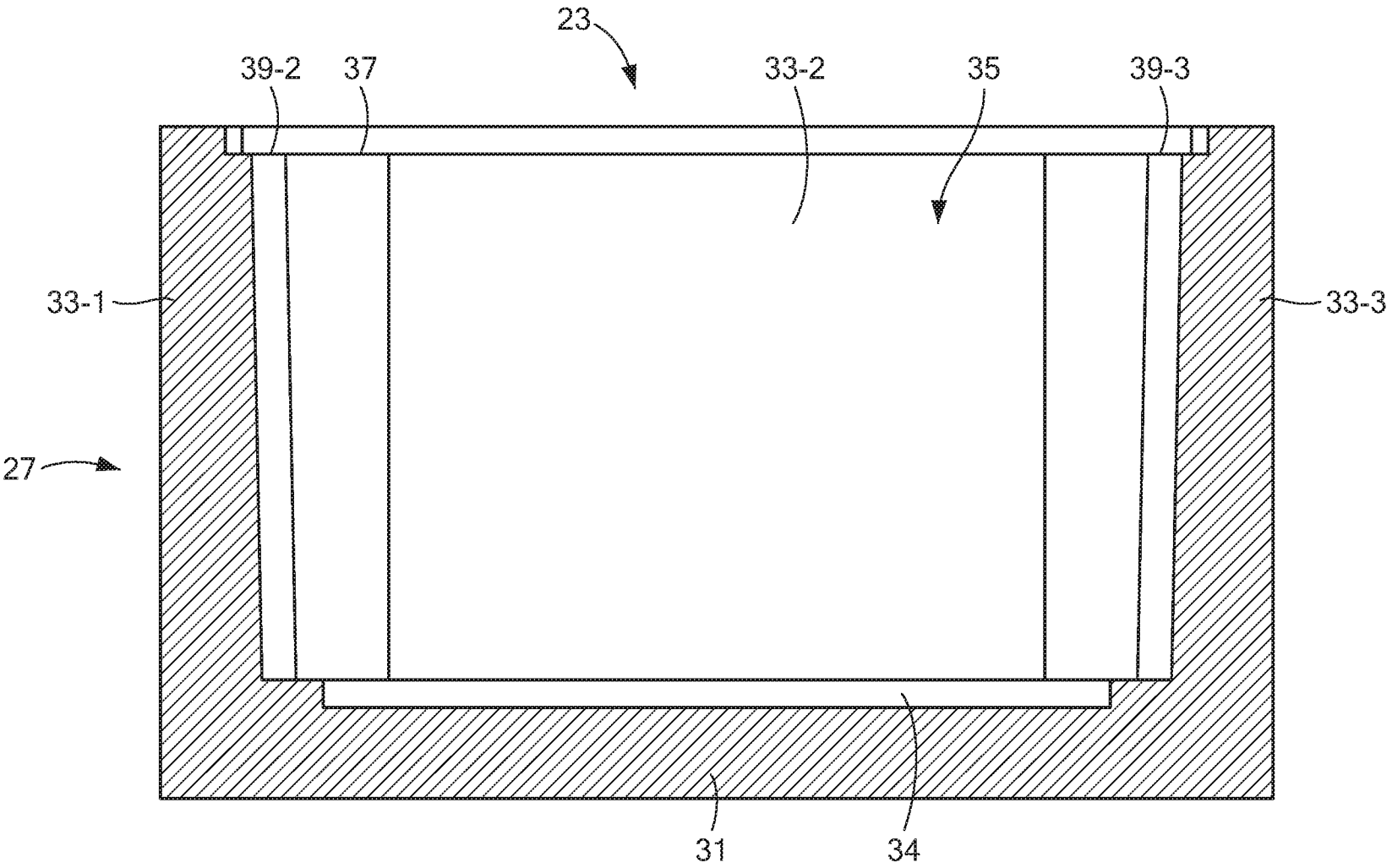
Figure 3C:
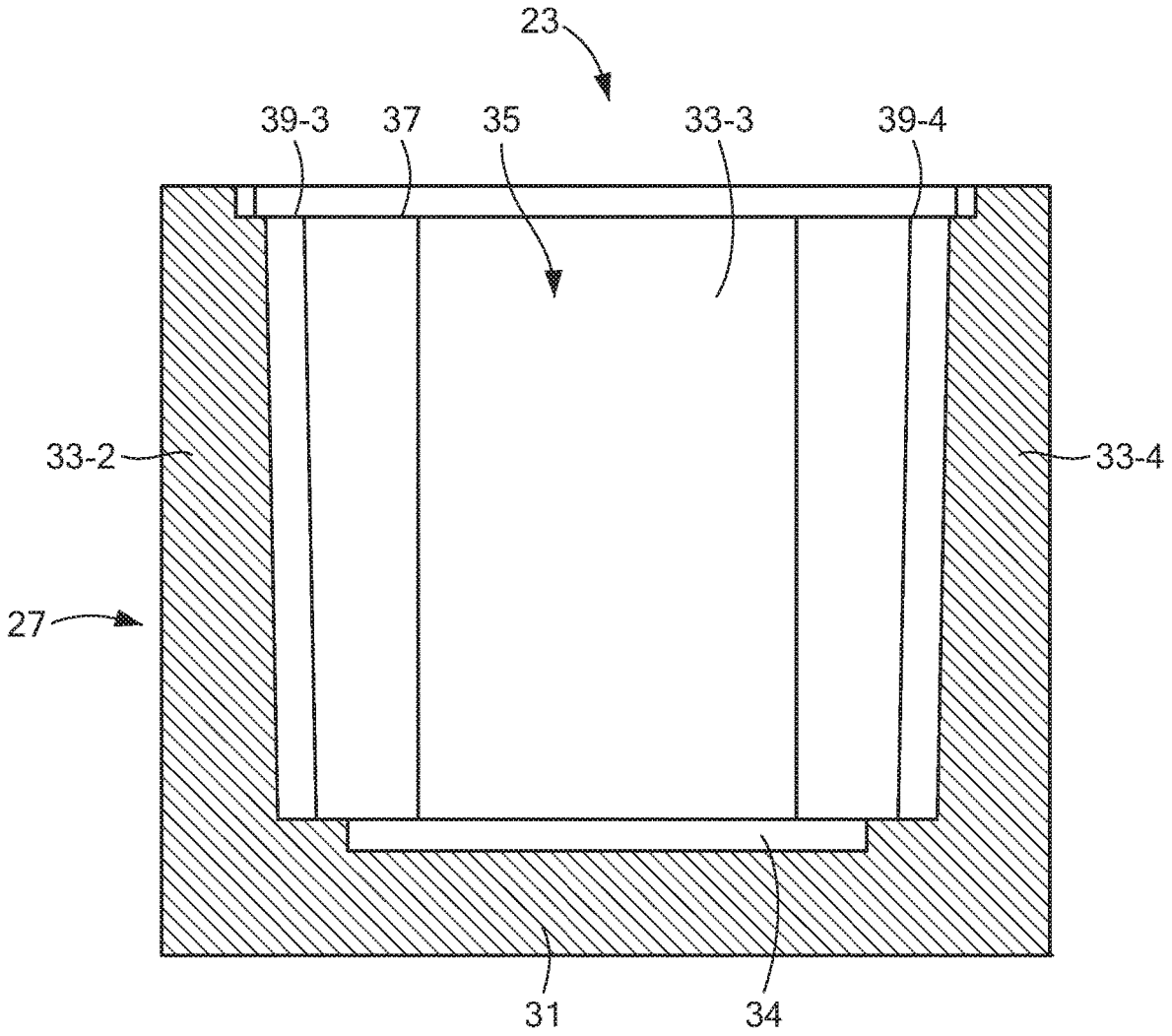
Figure 3D:
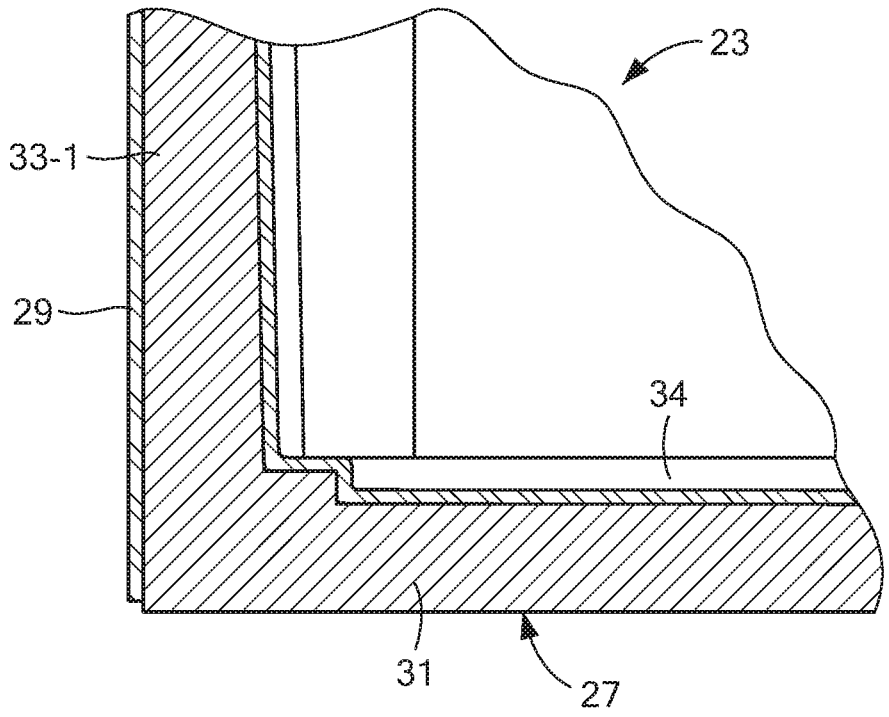

System 11 may additionally comprise a cooler base 21, which is also shown separately in FIG. 2. Cooler base 21, which may be snugly, but removably, disposed within outer box 13, may comprise an outer portion 23 and an inner portion 25.

Outer portion 23, which is also shown separately in FIGS. 3(*a*) through 3(*d*), may comprise a body 27 and a bag 29. (For simplicity, bag 29 is only shown in FIG. 3(*d*).) Body 27, which may be, but is not limited to, a unitary molded member comprising foamed polyurethane or a similar thermally-insulating material, may be shaped to include a bottom wall 31, four side walls 33-1 through 33-4 (wherein side walls 33-2 and 33-4 may be larger than side walls 33-1 and 33-3), and an open top. The interior of bottom wall 31 may comprise a centrally-recessed area 34, which may be dimensioned to matingly receive the bottom of inner portion 25. Bottom wall 31 and side walls 33-1 through 33-4 may collectively define a generally rectangular prismatic cavity 35 comprising a maximum length $l_1$ and a maximum width $w_1$, wherein length $l_1$ is approximately twice that of width $w_1$. The top surfaces of side walls 33-1 through 33-4 may collectively form a recessed shelf 37, and the abutting interior edges of side walls 33-1 through 33-4 may form corner posts 39-1 through 39-4. As will become apparent below, corner posts 39-1 through 39-4 may help to define cavities for holding temperature-control materials.

Bag 29, which may be a thin, flexible, non-self-supporting, unfoamed polymer bag of little or no thermally insulating value, may be integrally and conformingly bonded to the entirety of body 27, except for the exterior surface of bottom wall 31 (and, perhaps, a small portion of the adjacent exterior surfaces of side walls 33-1 through 33-4). Outer portion 23 may be made by a technique similar to that disclosed in U.S. Pat. No. 6,868,982.

Figure 4A:
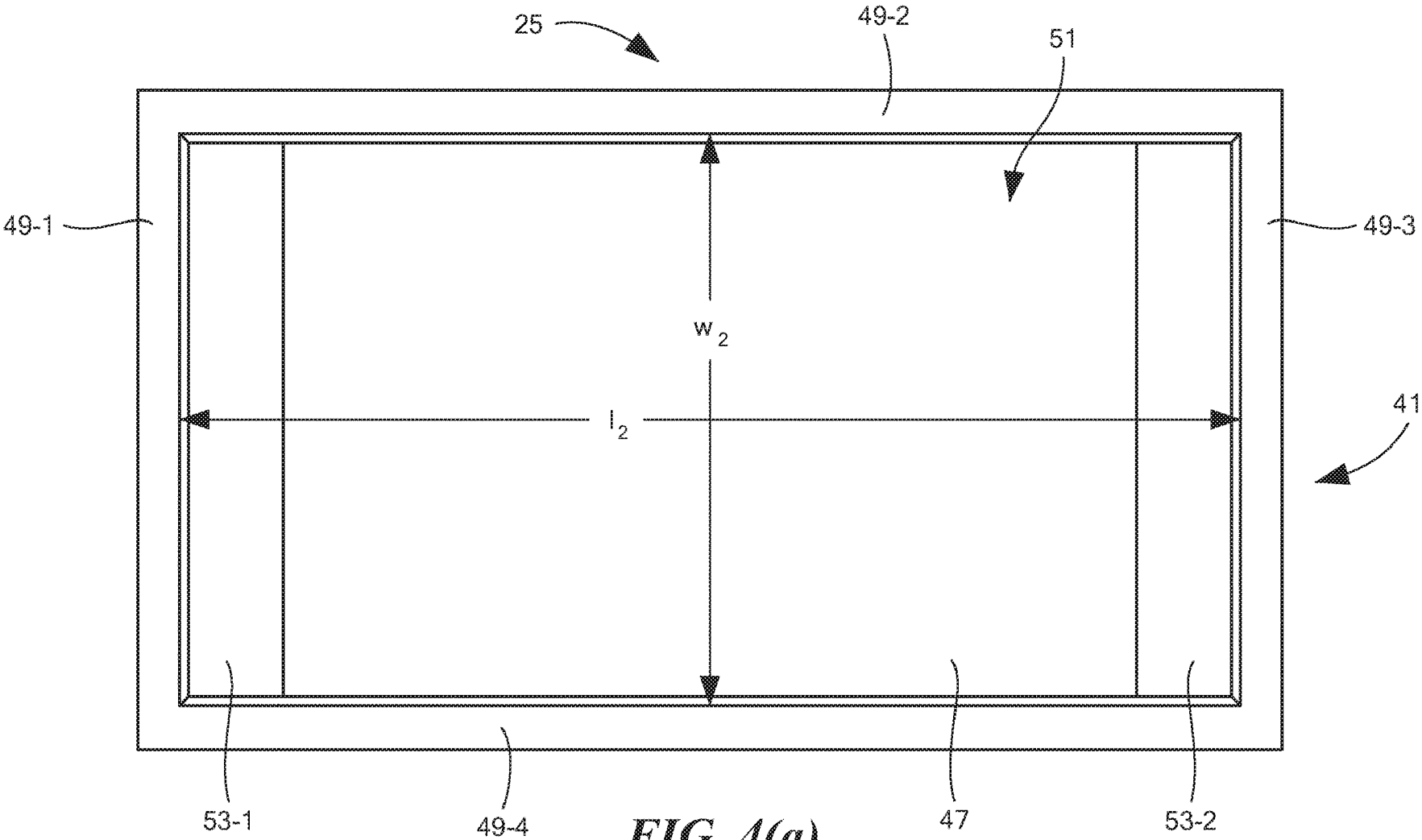
FIGS. 4(*a*) through 4(*c*) are top, longitudinal section, and lateral section views, respectively, of the inner portion of the cooler base shown in FIG. 2.
Figure 4B:
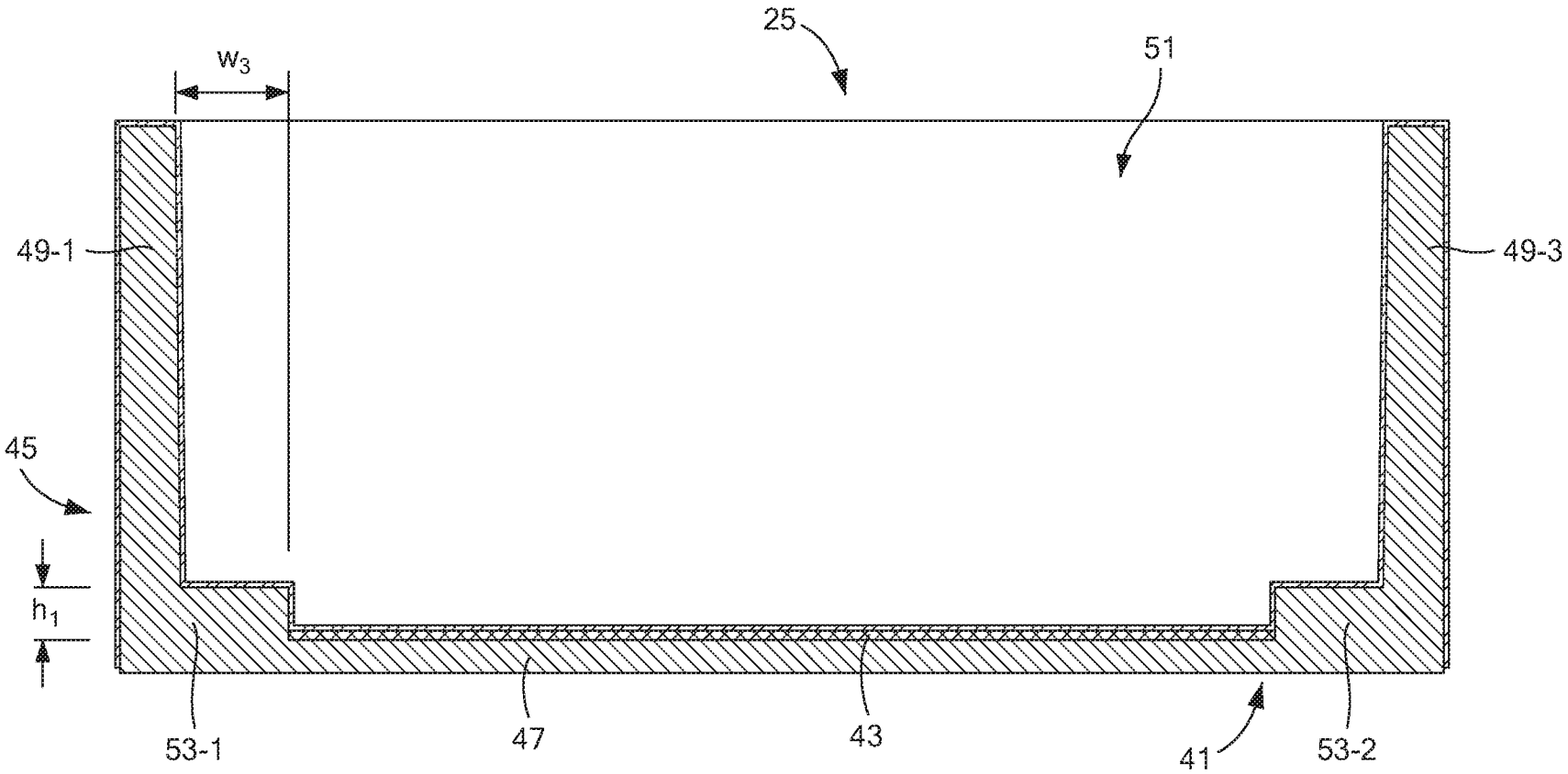
Figure 4C:
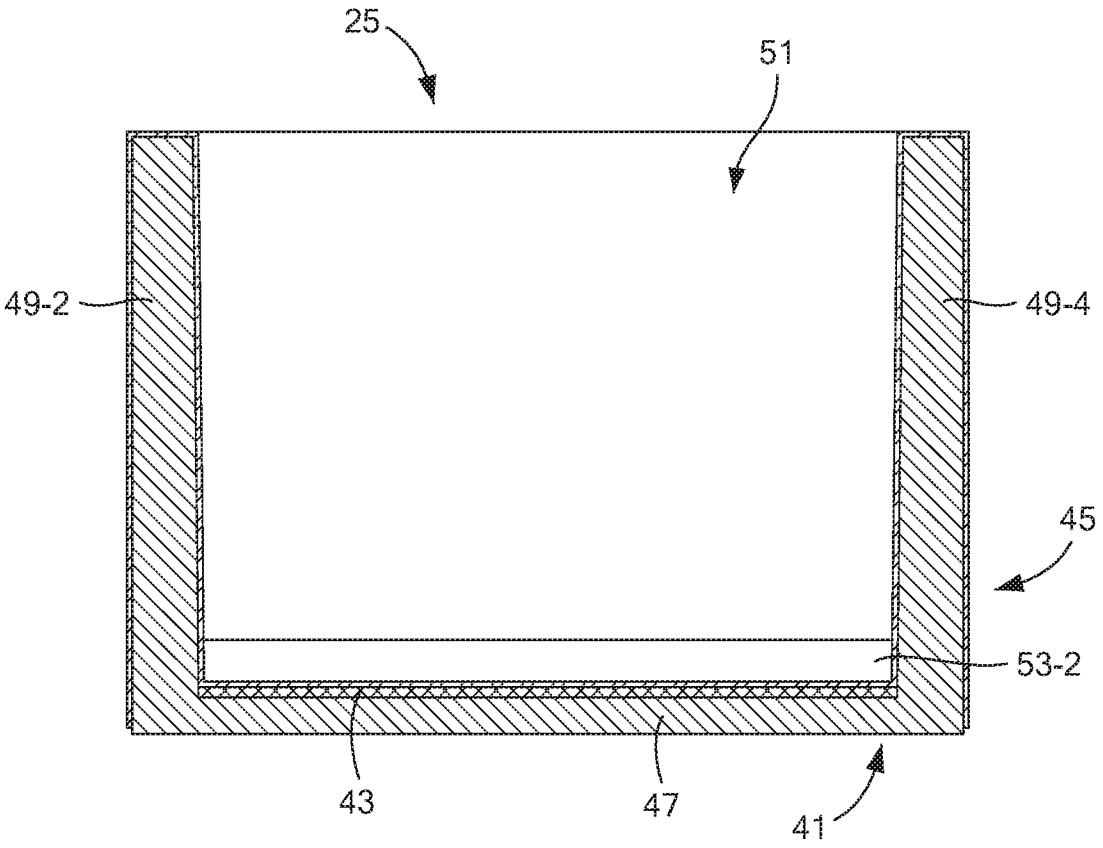

Inner portion 25, which is shown separately in FIGS. 4(*a*) through 4(*c*), may comprise, for example, a thermal insulation unit or body 41, a heat-spreader 43, and a bag 45. (For simplicity, bag 45 is only shown in FIGS. 4(*b*) and 4(*c*).) Body 41, which may be, but is not limited to, a unitary molded member comprising foamed polyurethane or a similar thermally-insulating material, may be shaped to include a bottom wall 47, four side walls 49-1 through 49-4 (wherein side walls 49-2 and 49-4 may be larger than side walls 49-1 and 49-3), and an open top. Bottom wall 47 and side walls 49-1 through 49-4 may collectively define a generally rectangular prismatic cavity 51 comprising a maximum length $l_2$ and a width $w_2$, wherein length $l_2$ is approximately twice that of width $w_2$. The abutting interior edges of bottom wall 47 and side wall 49-1 may form a step 53-1, and the abutting interior edges of bottom wall 47 and side wall 49-3 may form a step 53-2. Steps 53-1 and 53-2, the purpose of which is discussed below, each may have a height hi of approximately ¾ inch and a width $w_3$ of approximately ⅝ inch.

Heat-spreader 43 may comprise a thermally-conductive member, such as, but not limited to, a film or sheet consisting of or comprising a metal, a metal-coated or metal-containing material, a non-metallic thermally-conductive material, such as a graphite, or a combination thereof. In the present embodiment, heat-spreader 43 may be an aluminum sheet having a thickness of about 10 mil. Heat-spreader 43 may be disposed on top of body 41 and may cover the interior surface of bottom wall 47 in the area extending between steps 53-1 and 53-2. As will be discussed further below, heat-spreader 43 may serve to minimize thermal gradients around, and particularly under, a product box positioned within inner portion 25.

Bag 45, which may be a thin, flexible, non-self-supporting, unfoamed polymer bag, may be integrally and conformingly bonded to the entirety of body 41, except for the portion of body 41 covered by heat-spreader 43 (which bag 45, nonetheless, may cover) and the exterior surface of bottom wall 47 (and, perhaps, a small portion of the adjacent exterior surfaces of side walls 49-1 through 49-4).

Inner portion 25 may be made generally by a technique similar to that disclosed in U.S. Pat. No. 6,868,982, except that heat-spreader 43 may be adhered to the interior surface of bag 45 prior to the molding of body 41 within bag 45. More specifically, for example, bag 45 may be placed in a mold, heat-spreader 43 may be secured to an interior surface of bag 45 with an adhesive, such as 3M™ 77 SUPER™ multipurpose spray adhesive (3M Company, Maplewood, Minn.), and polyurethane foam may then be shot into bag 45 and over the opposite surface of heat-spreader 43.

Inner portion 25 and outer portion 23 may be permanently affixed to one another, for example, using a hot-melt adhesive, such as 3M™ Hot Melt Adhesive 3792 (3M Company, Maplewood, Minn.). More specifically, inner portion 25 and outer portion 23 may be permanently joined together by applying the aforementioned hot glue to the exterior bottom of inner portion 25 and/or to area 34 of outer portion 23 and then by mating the exterior bottom of inner portion 25 with area 34 of outer portion 23 while applying pressure until a permanent joining is effected.

Inner portion 25 may be dimensioned relative to outer portion 23 so that cavities may be jointly defined by inner portion 25 and outer portion 23. More specifically, a cavity 57-1 may be collectively defined by side wall 33-1 and bottom wall 31 of outer portion 25 and by side wall 49-1 of inner portion 23, a cavity 57-2 may be collectively defined by side wall 33-2 and bottom wall 31 of outer portion 25 and by side wall 49-2 of inner portion 23, a cavity 57-3 may be collectively defined by side wall 33-3 and bottom wall 31 of outer portion 23 and by side wall 49-3 of inner portion 25, and a cavity 57-4 may be collectively defined by side wall 33-4 and bottom wall 31 of outer portion 25 and by side wall 49-4 of inner portion 23.

System 11 may further comprise a product box 61, in which the temperature-sensitive materials (not shown) may be disposed. Product box 61, which may be a conventional corrugated cardboard box, may be appropriately dimensioned to be received within cavity 51 of inner portion 25 and, more specifically, may be appropriately dimensioned to be received on top of the portion of bag 45 disposed over heat-spreader 43. In the present embodiment, product box 61 may be a hollow structure dimensioned to define a payload volume of approximately 16 L (e.g., 15.0"×7⅛"×8⅞") and may have a generally rectangular shape, with four side walls of equal dimensions and two end walls of equal dimensions, the four side walls being of comparatively greater surface area than the two end walls.

System 11 may further comprise a first set of temperature-control members 71-1 through 71-4 for use in keeping a payload within a desired temperature range. Temperature-control members 71-1 through 71-4, which may be identical to one another, may be appropriately dimensioned to be received, along with product box 61, within cavity 51 of inner portion 25. Materials suitable for use as temperature-control members 71-1 through 71-4 are exemplified by, but are not limited to, conventional ice packs, conventional gel packs, or refrigerant packs of the type disclosed in U.S. Pat. No. 9,598,622 B2, inventors Formato et al., issued Mar. 21, 2017, and U.S. Patent Application Publication No. US 2018/0093816 A1, inventors Longley et al., published Apr. 5, 2018, both of which are incorporated herein by reference.

According to one embodiment, temperature-control members 71-1 through 71-4 may be in the form of flexible mats having a plurality of discrete sealed pouches, each pouch containing a quantity of a phase-change material (PCM). The phase-change material may be any phase-change material including any water-based or organic phase-change material. For example, if the phase-change material is water-based, the phase-change material may be water, a mixture of water and a thickener (e.g., a polysaccharide thickener) to produce a gelled water mixture, or a water/salt solution with an optional thickener.

Alternatively, if the phase-change material is an organic phase-change material, the phase-change material may be a gelled organic phase-change material, such as is disclosed in U.S. Pat. No. 9,598,622 B2 and U.S. Patent Application Publication No. US 2018/0093816 A1. More specifically, a suitable gelled organic phase-change material may comprise one or more n-alkanes, such as n-tetradecane (C14), n-pentadecane (C15), n-hexadecane (C16), n-heptadecane (C17), n-octadecane (C18), or combinations thereof, together with a gelling agent in the form of a styrene-ethylene-butylene-styrene triblock copolymer and/or a styrene-ethylene-propylene-styrene triblock copolymer. Solely for purposes of illustration, where, for example, system 11 is designed to keep a payload within a temperature range of +2° C. to +8° C., the gelled phase-change material may comprise a mixture of n-tetradecane (C14), n-hexadecane (C16), and KRATON™ G1654 styrene-ethylene-butylene-styrene (SEBS) tri-block copolymer, and such a gelled phase-change material may have a phase-change temperature of about 3° C. Alternatively, the gelled phase-change material may comprise a mixture of n-tetradecane (C14) and KRATON™ G1654 styrene-ethylene-butylene-styrene (SEBS) tri-block copolymer, and such a gelled phase-change material may have a phase-change temperature of about 5° C. On the other hand, where, for example, system 11 is designed to keep a payload within a temperature range of +15° C. to +25° C., the gelled phase-change material may comprise a mixture of n-hexadecane (C16) and KRATON™ G1654 styrene-ethylene-butylene-styrene (SEBS) tri-block copolymer, and such a gelled phase-change material may have a phase-change temperature of about 17° C. Each pouch of temperature-control members 71-1 through 71-4 may contain suitable masses of the phase-change material and the gelling agent for the particular application to which system 11 is put. For example, for the particular applications described above, each pouch may contain approximately 150-200 g of the n-alkane(s) and approximately 12-18 g of the gelling agent.

In the present embodiment, there are four temperature-control members 71-1 through 71-4, and each of temperature-control members 71-1 through 71-4 has four generally rectangular, trough-shaped pouches 72; however, it is to be understood that the number of temperature-control members 71-1 through 71-4 and the number and shape of pouches 72 in temperature-control members 71-1 through 71-4 are merely illustrative. Consequently, the number of temperature-control members 71, as well as the number and shape of pouches 72 therein, may be varied while still coming within the scope of the present invention. In fact, in some cases, there may be as few as one temperature-control member 71. Moreover, while, in the present embodiment, each pouch 72 of temperature-control members 71-1 through 71-4 contains the same quantity and type of phase-change material, this need not be so as some of temperature-control members 71-1 through 71-4 may contain different phase-change materials than others of temperature-control members 71-1 through 71-4 and/or different pouches of the same temperature-control member may contain different types of phase-change materials.

Temperature-control members 71-1 through 71-4 and product box 61 may be appropriately dimensioned and arranged within cavity 51 of inner portion 25 as follows: First, product box 61 may be positioned directly on top of the portion of bag 45 disposed over heat-spreader 43. Temperature-control member 71-1 may be arranged within cavity 51 so that two of its four pouches 72 are positioned on top of step 53-1 at one end of product box 61 and so that two of its four pouches 72 are positioned directly on top of product box 61. In a corresponding fashion, temperature-control member 71-2 may be arranged within cavity 51 so that two of its four pouches 72 are positioned on top of step 53-2 at the opposite end of product box 61 and so that two of its four pouches 72 are positioned directly on top of product box 61. Temperature-control member 71-3 may be arranged within cavity 51 so that its four pouches 72 are positioned in direct contact with one side of product box 61, and temperature-control member 71-4 may be arranged within cavity 51 so that its four pouches 72 are positioned in direct contact with the opposite side of product box 61. The bottoms of temperature-control members 71-3 and 71-4 are preferably positioned directly on top of the portion of bag 45 directly over heat-spreader 43 so that temperature-control members 71-3 and 71-4 are in thermal contact with heat-spreader 43 through bag 45. In this manner, the thermal effects of temperature-control members 71-3 and 71-4 may be dispersed by heat-spreader 43 throughout the area under product box 61. In other words, heat-spreader 43 may serve to cool the bottom of product box 61—without requiring a temperature-control member to be positioned below product box 61. Preferably, cavity 51, product box 61, and temperature-control members 71-1 through 71-4 are dimensioned so that temperature-control members 71-1 through 71-4 fit snugly around product box 61. Moreover, temperature-control members 71-1 and 71-2, product box 61, and steps 53-1 and 53-2 are preferably dimensioned to ensure that two pouches 72 of each of temperature-control member 71-1 and temperature-control member 71-2 are positioned at the ends of product box 61 and so that two pouches 72 of each of temperature-control member 71-1 and temperature-control member 71-2 are positioned on top of product box 61. In fact, the primary purpose of steps 53-1 and 53-2 is to keep temperature-control members 71-1 and 71-2 properly positioned relative to product box 61 so as to prevent temperature-control members 71-1 and 71-2 from sliding downwardly or otherwise moving in an undesirable fashion relative to product box 61 during shipping.

As can be appreciated, the method described above is exemplary; accordingly, the order in which temperature-control members 71-1 through 71-4 are placed around product box 61 may be varied without departing from the present invention. Moreover, temperature-control members 71-1 through 71-4 may be interchangeably positioned.

Figure 5A:
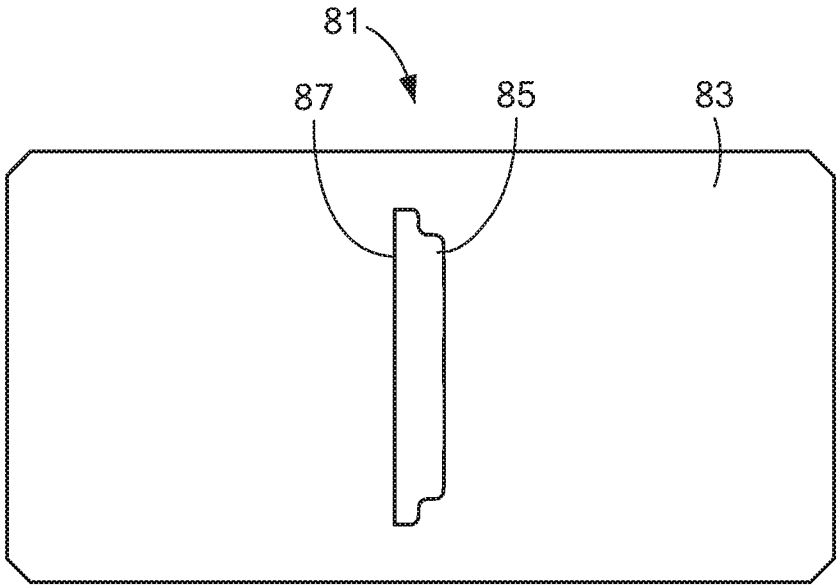
FIGS. 5(*a*) and 5(*b*) are top views of the foam pad shown in FIG. 1, the foam pad being shown with the divider flush to the base and perpendicular to the base, respectively.
Figure 5B:
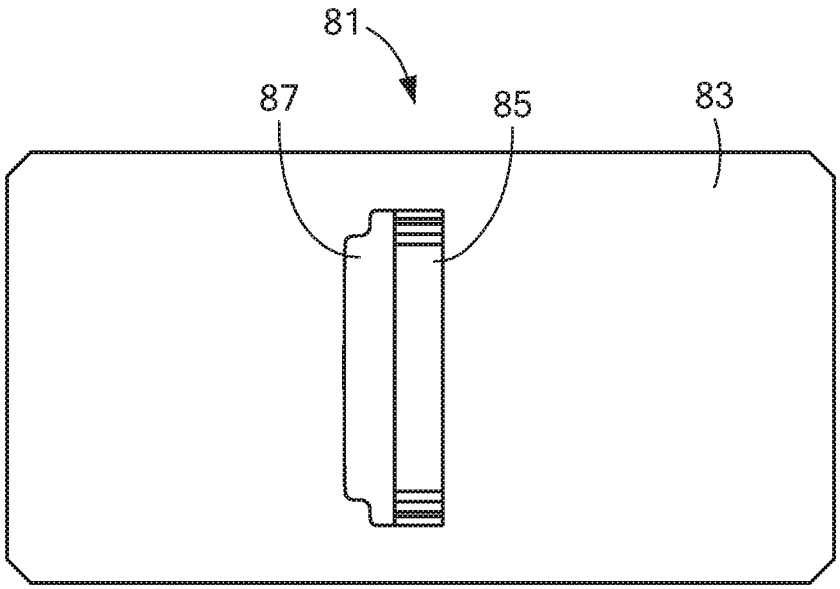

System 11 may further comprise a foam pad 81, which is also shown separately in FIGS. 5(*a*) and 5(*b*). Foam pad 81, which may be a unitary structure made of a molded polyethylene foam or a similar thermally-insulating material, may be shaped to comprise a generally planar base 83 and a divider 85. Divider 85, which may be used to separate temperature-control members positioned on base 83 and to minimize their movement, may be integrally-formed with and hingedly connected to base 83. In this manner, when foam pad 81 is not in use, divider 85 may be pivoted into a complementarily-shaped opening 87 provided in base 83, thereby reducing the size of foam pad 81 for storage. By contrast, when foam pad 81 is to be prepared for use, divider 85 may be pivoted out of opening 87 so as to extend generally perpendicularly to base 83. Foam pad 81 may be appropriately dimensioned to fit within cavity 51 on top of the pouches 72 of temperature-control members 71-1 and 71-2 that are positioned over product box 61.

System 11 may further comprise a second set of temperature-control members 91-1 through 91-8. Temperature-control members 91-1 through 91-8 may be used to keep the contents of product box 61 within a desired temperature range, for example, by helping to maintain temperature-control members 71-1 through 71-4 within their pre-conditioned temperature range. For example, where temperature-control members 71-1 through 71-4 are designed to maintain a payload within a temperature range of 2° C. to 8° C., temperature-control members 91-1 through 91-8 may be pre-conditioned to a lower temperature range, such as −15° C. to −25° C., to act as a buffer against warm external ambient temperatures.

Temperature-control members 91-1 through 91-8, which may be identical to one another, may be appropriately dimensioned to be positioned within cavities 57-1 through 57-4 and on top of foam pad 81 in the manner to be discussed below. Materials suitable for use as temperature-control members 91-1 through 91-8 are exemplified by, but are not limited to, conventional ice packs, conventional gel packs, or refrigerant packs of the type disclosed in U.S. Pat. No. 9,598,622 B2, inventors Formato et al., issued Mar. 21, 2017, and U.S. Patent Application Publication No. US 2018/0093816 A1, inventors Longley et al., published Apr. 5, 2018, both of which are incorporated herein by reference. In the present embodiment, temperature-control members 91-1 through 91-8 are preferably conventional water-impregnated foam refrigerant bricks of the type commercially available from Cold Chain Technologies, Inc. (Franklin, Mass.) as KOOLIT® 365F foam refrigerant bricks, such bricks having a weight of approximately 28.2 ounces.

Temperature-control members 91-1 through 91-8 may be appropriately dimensioned to be arranged as follows: Temperature-control member 91-1 may be positioned within cavity 57-1, temperature-control members 91-2 and 91-3 may be positioned within cavity 57-2, temperature-control member 91-4 may be positioned within cavity 57-3, and temperature-control members 91-5 and 91-6 may be positioned within cavity 57-4. Temperature-control members 91-7 and 91-8 may be positioned on top of foam pad 81 on opposite sides of divider 85. Preferably, temperature-control members 91-1 through 91-8 are appropriately dimensioned to minimize their movement during use.

As can be appreciated, the arrangement of temperature-control members 91-1 through 91-8 in the manner described above is exemplary; accordingly, the order in which temperature-control members 91-1 through 91-8 are positioned may be varied without departing from the present invention. Moreover, temperature-control members 91-1 through 91-8 may be interchangeably positioned. Furthermore, it is to be understood that the number and placement of temperature-control members 91-1 through 91-8 are merely illustrative. Consequently, the number and placement of temperature-control members 91 may be varied while still coming within the scope of the present invention. In fact, in some cases, there may be as few as one temperature-control member 91.

Figure 6:
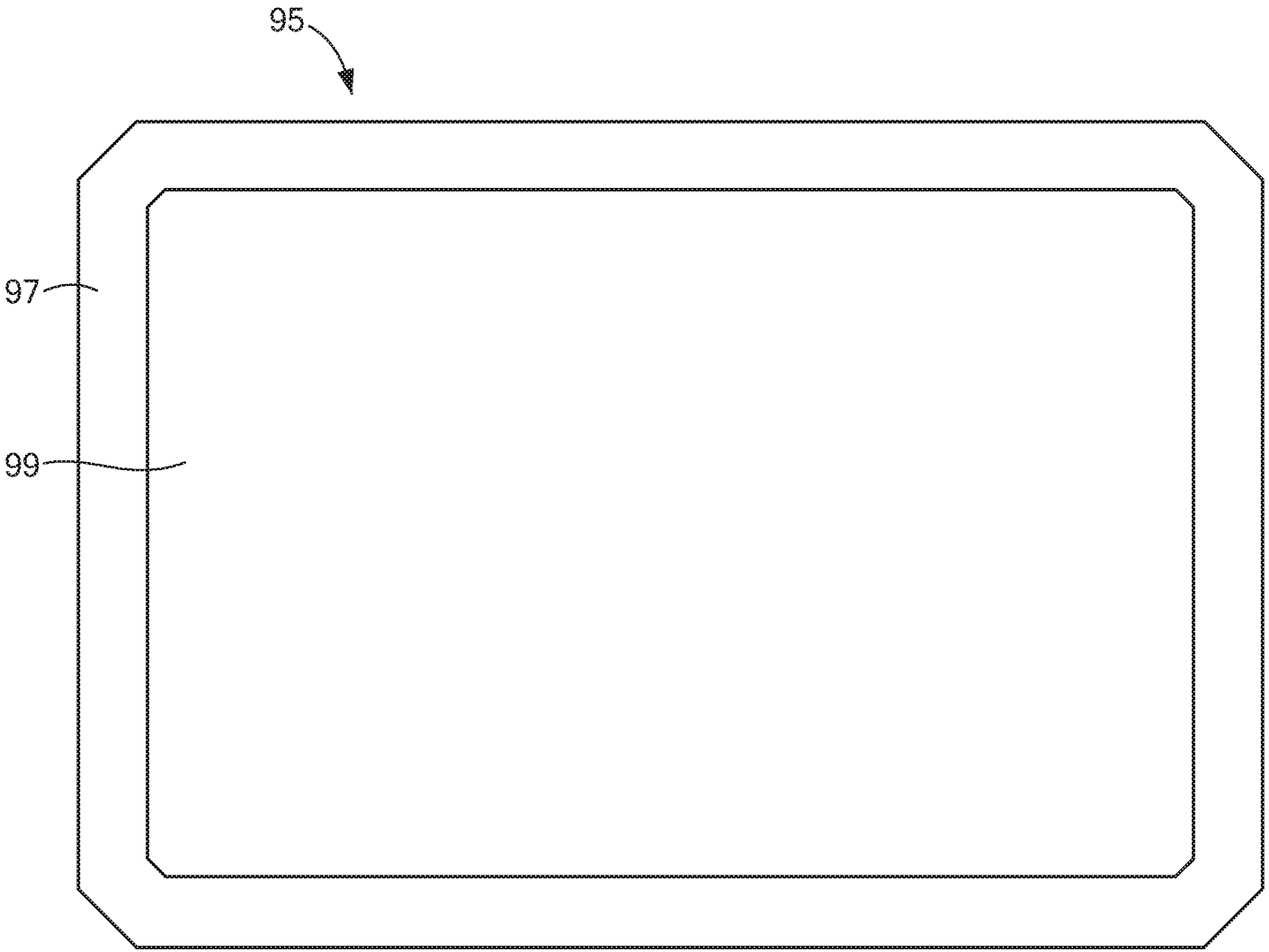
FIG. 6 is a bottom view of the lid shown in FIG. 1.

System 11 may further comprise a lid 95, which is also shown separately in FIG. 6. Lid 95 may be shaped to comprise a top portion 97 and a bottom portion 99. Top portion 97 may be appropriately dimensioned to sit upon and to generally match the outer dimensions of cooler base 21. Bottom portion 99 may have an outer periphery that is appropriately dimensioned to abut the inner surfaces of side walls 33-1 through 33-4 above shelf 37, thereby sealing the open top of cooler base 21. Once lid 95 has been placed on cooler base 21, top closure flaps 19-1 through 19-4 of outer box 13 may be closed and sealed, for example, with packing tape.

Lid 95 may have a composition similar to that of outer portion 23 and may be made by a technique similar to that disclosed in U.S. Pat. No. 6,868,982. Accordingly, lid 95 may comprise a unitary body of foamed polyurethane material or a similar thermally-insulating material encased in a thin, flexible, non-self-supporting, unfoamed polymer bag, except for the exterior top surface of top portion 97 (and, perhaps, a small portion of the adjacent exterior side surfaces of top portion 97).

System 11 minus temperature-control members 71-1 through 71-4 and temperature-control members 91-1 through 91-8 may be referred to herein as a shipper.

Although system 11 may be delivered to a user with temperature-control members 71-1 through 71-4 and temperature control members 91-1 through 91-8 arranged in the shipper in the manner described above, one need not deliver system 11 in this fashion. Rather, the shipper may be delivered, with temperature-control members 71-1 through 71-4 and temperature-control members 91-1 through 91-8 being delivered outside of the shipper. (In fact, if desired, temperature-control members 71 and temperature-control members 91 may be delivered in bulk to a user and used as needed. Moreover, product box 61 may also be delivered to a user separately of the rest of the shipper.) Prior to using system 11, a user may pre-condition temperature-control members 71-1 through 71-4 and temperature-control members 91-1 through 91-8, as well as the shipper, and then may assemble system 11 with the pre-conditioned temperature-control members, preferably at a desired pack-out temperature.

For example, where system 11 is used to maintain a payload within a temperature range of +2° C. to +8° C., the product load may be pre-conditioned at +5° C.±3° C., temperature-control members 71-1 through 71-4 may contain a phase-change material having a phase-change temperature of +3° C. and may be pre-conditioned at +5° C.±3° C., temperature-control members 91-1 through 91-8 may contain a phase-change material having a phase-change temperature of 0° C. and may be pre-conditioned at −15° C. to −25° C., the shipper may be pre-conditioned at +20° C.±5° C., and the above-described steps for assembling system 11 may be conducted at +5° C.±3° C. Alternatively, to maintain a payload within a temperature range of +15° C. to +25° C., the product load may be pre-conditioned at +20° C.±5° C., temperature-control members 71-1 through 71-4 may contain a phase-change material having a phase-change temperature of +17° C. and may be pre-conditioned at +20° C.±5° C., temperature-control members 91-1 through 91-8 may contain a phase-change material having a phase-change temperature of 0° C. and may be pre-conditioned at +20° C.±5° C., the shipper may be pre-conditioned at +20° C.±5° C., and the above-described steps for assembling system 11 may be conducted at +20° C.±5° C. In other embodiments, it may be desirable to have different pouches of the same temperature-control member or of different temperature-control members contain different types of phase-change materials. Furthermore, in certain embodiments, whether the same phase-change materials or different phase-change materials are used, it may be desirable to pre-condition some temperature-control members at a first temperature and to pre-condition other temperature control-members at a second (i.e., different) temperature.

In another embodiment, the shipper of system 11 may be used without temperature-control members 71-1 through 71-4, temperature-control members 91-1 through 91-8, and foam pad 81. For example, according to one such embodiment, dry ice may be used instead of temperature-control members 71-1 through 71-4 and temperature-control members 91-1 through 91-8. More specifically, for example, one may position product box 61 inside and against one corner of inner portion 25 of cooler base 21 and may fill the spaces around product box 61 within inner portion 25 of cooler base with a quantity of pelletized dry ice (e.g., approximately 15.0 lbs). In addition, one may place an additional quantity of pelletized dry ice (e.g., approximately 5.0 lbs) on top of product box 61. Additionally, one may place further quantities of pelletized dry ice in cavities 57-1 through 57-4 (e.g., approximately 3.0 lbs in each of cavities 57-1 and 57-3 and approximately 5.0 lbs in each of cavities 57-2 and 57-4). In this embodiment, because two layers of phase-change material are not positioned over product box 61, there is no need for foam pad 81.

System 11 possesses a number of advantageous features. One such advantageous feature is that heat-spreader 43 may obviate the need for a temperature-control member or other refrigerant below product box 61. This may be beneficial in that the costs associated with system 11 may be reduced by reducing the number of temperature-control members employed. In addition, such an arrangement may reduce the weight of system 11 and/or may allow for an increased payload volume without requiring an increase in the overall size of system 11. Moreover, such an arrangement reduces the number of parts required to assemble system 11 and, therefore, reduces the labor required to assemble system 11 (such a reduction in labor being particularly advantageous to a user that does not receive system 11 in a pre-assembled state, but rather, must assemble system 11). Furthermore, such an arrangement eliminates the risk that the payload may cause the rupture or other damage to a temperature-control member positioned below product box 61. As can be appreciated, the weight of the payload may be significant; consequently, if system 11 is jostled during shipping, a temperature-control member situated beneath the payload may be subjected to considerable pressure that it may not be able to withstand over time.

Another advantageous feature of system 11 is that steps 53-1 and 53-2 may minimize a downward sliding movement of temperature-control members 71-1 and 71-2 relative to product box 61.

Still another advantageous feature of system 11 is that temperature-control members 71-1 through 71-4 may be interchangeably positioned. As a result, any one of temperature-control members 71-1 through 71-4 may be used at the location of any other. In other words, for example, the location at which temperature-control member 71-1 is positioned and the location at which temperature-control member 71-2 (or temperature-control member 71-3 or temperature-control member 71-4) is positioned may be switched. Moreover, temperature-control members 71-1 through 71-4 may employ a variety of different phase-change materials (e.g., by having different pouches of the same temperature-control member contain different phase-change materials or by having some of temperature-control members 71-1 through 71-4 contain a different phase-change material than others of temperature-control members 71-1 through 71-4 or by replacing a first phase-change material within temperature-control members 71-1 through 71-4 with a second phase-change material or by some combination of the above) and/or may be pre-conditioned at different temperatures. Consequently, with a single shipper, one may tailor system 11 to maintain a payload within a variety of different temperature ranges.

Still a further advantageous feature of system 11 is that temperature-control members 91-1 through 91-8 may be interchangeably positioned. As a result, any one of temperature-control members 91-1 through 91-8 may be used at the location of any other. In other words, for example, the location at which temperature-control member 91-1 is positioned and the location at which temperature-control member 91-2 (or temperature-control member 91-3 or temperature-control member 91-4 or temperature-control member 91-5 or temperature-control member 91-6 or temperature-control member 91-7 or temperature-control member 91-8) is positioned may be switched. Moreover, temperature-control members 91-1 through 91-8 may employ a variety of different phase-change materials (e.g., by having some of temperature-control members 91-1 through 91-8 contain a different phase-change material than others of temperature-control members 91-1 through 91-8 or by replacing a first phase-change material within temperature-control members 91-1 through 91-8 with a second phase-change material or by some combination of the above) and/or be pre-conditioned at different temperatures. Consequently, with a single shipper, one may tailor system 11 to maintain a payload within a variety of different temperature ranges.

Figure 7:
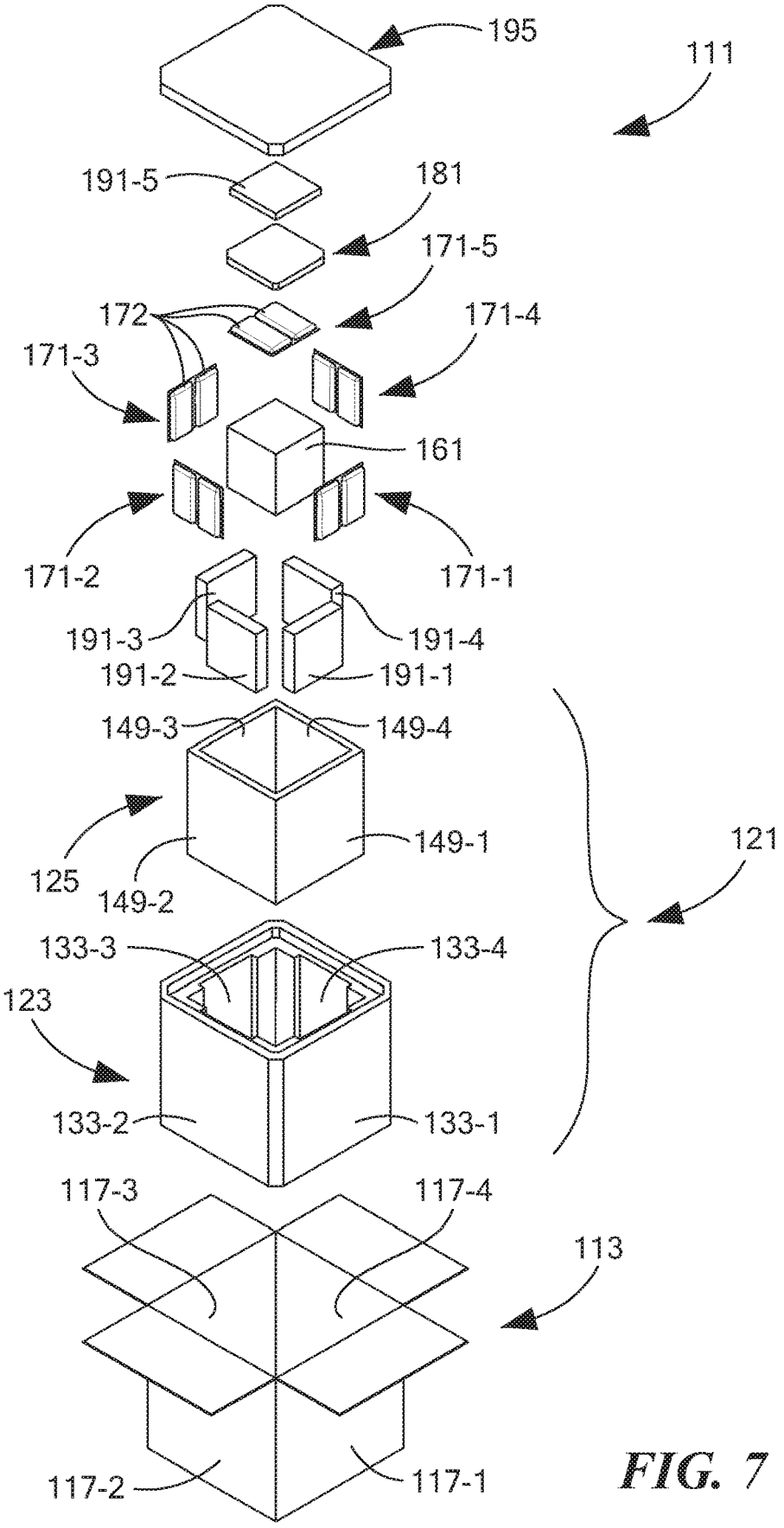
FIG. 7 is a partly exploded perspective view of a second embodiment of a shipping system suitable for use in storing and/or transporting temperature-sensitive materials, the shipping system being constructed according to the present invention.

Referring now to FIG. 7, there is shown a partly exploded perspective view of a second embodiment of a shipping system suitable for use in storing and/or transporting temperature-sensitive materials, the shipping system being constructed according to the present invention and being represented generally by reference numeral 111. For clarity and/or ease of illustration, certain details of shipping system 111 that are discussed elsewhere in this application or that are not critical to an understanding of the invention may be omitted from FIG. 7 or may be shown therein in a simplified manner.

System 111 may be similar in many respects to system 11 but may be designed for a different payload volume, for example, approximately 8 L, instead of approximately 16 L. System 111 may comprise an outer box 113, a cooler base 121, a product box 161, a first set of temperature-control members 171-1 through 171-5, a foam pad 181, a second set of temperature-control members 191-1 through 191-5, and a lid 195.

Outer box 113 may be similar in construction and composition to outer box 13 of system 11, except that outer box 113 may be dimensioned to accommodate a different payload volume, for example, approximately 8 L, instead of approximately 16 L. In addition, in the present embodiment, outer box 113 may have four side walls of 117-1 through 117-4 of generally equal size whereas outer box 13 may have two side walls, namely, side walls 17-2 and 17-4 that may be larger than two other side walls, namely, side walls 17-1 and 17-3.

Cooler base 121 may be similar in construction and composition to cooler base 21 of system 11, except that cooler base 121 may comprise an outer portion 123 and an inner portion 125. Outer portion 123 and inner portion 125 may be similar to outer portion 23 and inner portion 25, respectively, of system 11, except that inner portion 125 may omit structures corresponding to steps 53-1 and 53-2 of inner portion 25. In addition, outer portion 123 and inner portion 125 may be dimensioned to accommodate a different payload volume, for example, 8 L, instead of 16L. Moreover, outer portion 123 may comprise four side walls 133-1 through 133-4 of generally equal size, and inner portion 125 may comprise four side walls 149-1 through 149-4 of generally equal size.

Product box 161 may be similar in construction and composition to product box 61 of system 11, except that product box 161 may be dimensioned for a different payload volume, for example, approximately 8 L (e.g., 7⅛"×7⅛"×8⅞"), instead of approximately 16 L.

First set of temperature-control members 171-1 through 171-5 may be similar in construction and composition to temperature-control members 71-1 through 71-4 of system 11 and may include the same types of modifications discussed above in connection with temperature-control members 71-1 through 71-4 of system 11, a principal difference between the respective temperature-control members being that each of temperature-control members 171-1 through 171-5 may comprise two pouches 172, instead of four pouches 72. Also, whereas each of temperature-control members 71-1 and 71-2 of system 11 may be positioned along two faces of product box 61, each of temperature-control members 171-1 through 171-4 may be positioned only along a single side face of product box 161, and temperature-control member 171-5 may be positioned only along the top face of product box 161. For the above reasons, system 111 may comprise five temperature-control members 171-1 through 171-5 whereas system 11 may comprise four temperature-control members 71-1 through 71-4. The bottoms of temperature-control members 171-1 through 171-4 are preferably positioned directly on top of the portion of the bag of inner portion 125 that is directly over the heat-spreader so that temperature-control members 171-1 through 171-4 are in thermal contact with the heat-spreader through the bag. Like temperature-control members 71-1 through 71-4, temperature-control members 171-1 through 171-5 may be interchangeably positioned.

Foam pad 181 may be similar in construction and composition to foam pad 81 of system 11, except that foam pad 181 may be dimensioned to accommodate a different payload volume, for example, approximately 8 L, instead of approximately 16 L. In addition, foam pad 181 may omit divider 85 of foam pad 81.

Second set of temperature-control members 191-1 through 191-5 may be identical in construction and composition to temperature-control members 91-1 through 91-8 of system 11 and may include the same types of modifications discussed above in connection with temperature-control members 91-1 through 91-8 of system 11, the only difference being that system 111 may position only four such temperature-control members around the outside of the side walls of inner portion 125 (as opposed to six such temperature-control members in system 11) and one such temperature-control member over pad 81 (as opposed to two such temperature-control members in system 11). Like temperature-control members 91-1 through 91-8, temperature-control members 191-1 through 191-5 may be interchangeably positioned.

Lid 195 may be similar in construction and composition to lid 95 of system 11, except that lid 195 may be dimensioned for cooler base 121.

System 111 may be used in the same manner as system 11. In particular, the same types of phase-change materials employed in system 11 and the same types of pre-conditioning and assembling conditions employed in system 11 may be used in system 111. Accordingly, system 111 may be used, for example, to maintain a payload within a temperature range of +2° C. to +8° C., within a temperature range of +15° C. to +25° C., below −20° C., or at other temperatures for an extended period of time, such as 4 days or longer.

In another embodiment (not shown), system 111 may be modified by omitting the heat-spreader from inner portion 125.

Figure 8:
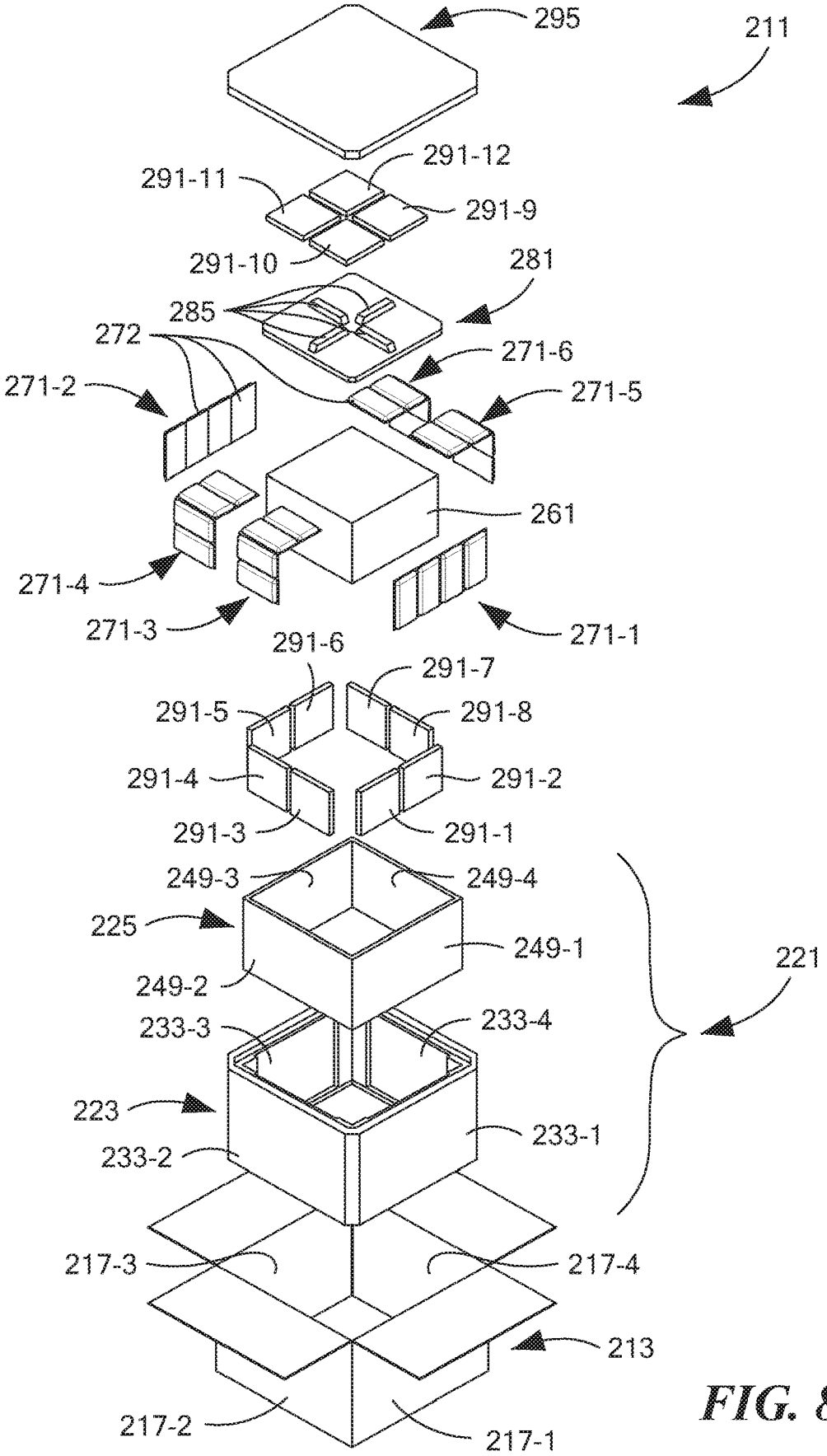
FIG. 8 is a partly exploded perspective view of a third embodiment of a shipping system suitable for use in storing and/or transporting temperature-sensitive materials, the shipping system being constructed according to the present invention.

Referring now to FIG. 8, there is shown a partly exploded perspective view of a third embodiment of a shipping system suitable for use in storing and/or transporting temperature-sensitive materials, the shipping system being constructed according to the present invention and being represented generally by reference numeral 211. For clarity and/or ease of illustration, certain details of shipping system 211 that are discussed elsewhere in this application or that are not critical to an understanding of the invention may be omitted from FIG. 8 or may be shown therein in a simplified manner.

System 211 may be similar in many respects to system 11 but may be designed for a different payload volume, for example, approximately 32 L, instead of approximately 16

L. System 211 may comprise an outer box 213, a cooler base 221, a product box 261, a first set of temperature-control members 271-1 through 271-6, a foam pad 281, a second set of temperature-control members 291-1 through 291-12, and a lid 295.

Outer box 213 may be similar in construction and composition to outer box 13 of system 11, except that outer box 213 may be dimensioned to accommodate a different payload volume, for example, approximately 32 L, instead of approximately 16 L. In addition, in the present embodiment, outer box 213 may have four side walls of 217-1 through 217-4 of generally equal size whereas outer box 13 may have two side walls, namely, side walls 17-2 and 17-4 that may be larger than two other side walls, namely, side walls 17-1 and 17-3. Although not shown, handles may be provided on two opposing side walls of outer box 213.

Cooler base 221 may be similar in construction and composition to cooler base 21 of system 11, except that cooler base 221 may comprise an outer portion 223 and an inner portion 225. Outer portion 223 and inner portion 225 may be similar to outer portion 23 and inner portion 25, respectively, of system 11, except that inner portion 225 may omit structures corresponding to steps 53-1 and 53-2 of inner portion 25. In addition, outer portion 223 and inner portion 225 may be dimensioned to accommodate a different payload volume, for example, 32 L, instead of 16L. Moreover, outer portion 223 may comprise four side walls 233-1 through 233-4 of generally equal size, and inner portion 225 may comprise four side walls 249-1 through 249-4 of generally equal size.

Product box 261 may be similar in construction and composition to product box 61 of system 11, except that product box 261 may be dimensioned for a different payload volume, for example, approximately 32 L (e.g., 15.0"× 15.0"×8⅝"), instead of approximately 16 L.

First set of temperature-control members 271-1 through 271-6 may be similar in construction and composition to temperature-control members 71-1 through 71-4 of system 11 and may include the same types of modifications discussed above in connection with temperature-control members 71-1 through 71-4 of system 11. Temperature-control members 271-1 and 271-2 may be positioned along two opposing side faces of product box 261. Two pouches 272 of each of temperature-control members 271-3 and 271-4 may be positioned along one of the other two opposing side faces of product box 261, and the other two pouches of each of temperature-control members 271-3 and 271-4 may be positioned along the top of product box 261. Similarly, two pouches 272 of each of temperature-control members 271-5 and 271-6 may be positioned along the other of the two opposing side faces of product box 261, and the other two pouches of each of temperature-control members 271-5 and 271-6 may be positioned along the top of product box 261. For the above reasons, system 211 may comprise six temperature-control members 271-1 through 271-6 whereas system 11 may comprise four temperature-control members 71-1 through 71-4. The bottoms of temperature-control members 271-1 through 271-6 are preferably positioned directly on top of the portion of the bag of inner portion 225 that is directly over the heat-spreader so that temperature-control members 271-1 through 271-6 are in thermal contact with the heat-spreader through the bag. Like temperature-control members 71-1 through 71-4, temperature-control members 271-1 through 271-6 may be interchangeably positioned.

Foam pad 281 may be similar in construction and composition to foam pad 81 of system 11, except that foam pad 281 may be dimensioned to accommodate a different payload volume, for example, approximately 32 L, instead of approximately 16 L. In addition, foam pad 281 may comprise a plurality of dividers 285 for separating four temperature-control members, as opposed to a single divider for separating two temperature-control members, as in foam pad 81.

Second set of temperature-control members 291-1 through 291-12 may be identical in construction and composition to temperature-control members 91-1 through 91-8 of system 11 and may include the same types of modifications discussed above in connection with temperature-control members 91-1 through 91-8 of system 11, the only difference being that system 211 may position eight such temperature-control members around the outside of the side walls of inner portion 225 (as opposed to six such temperature-control members in system 11) and four such temperature-control member over foam pad 281 (as opposed to two such temperature-control members in system 11). Like temperature-control members 91-1 through 91-8, temperature-control members 291-1 through 291-12 may be interchangeably positioned.

Lid 295 may be similar in construction and composition to lid 95 of system 11, except that lid 295 may be dimensioned for cooler base 221.

System 211 may be used in the same manner as system 11. In particular, the same types of phase-change materials employed in system 11 and the same types of pre-conditioning and assembling conditions employed in system 11 may be used in system 211. Accordingly, system 211 may be used, for example, to maintain a payload within a temperature range of +2° C. to +8° C., within a temperature range of +15° C. to +25° C., below −20° C., or at other temperatures for an extended period of time, such as 4 days or longer.

Figure 9:
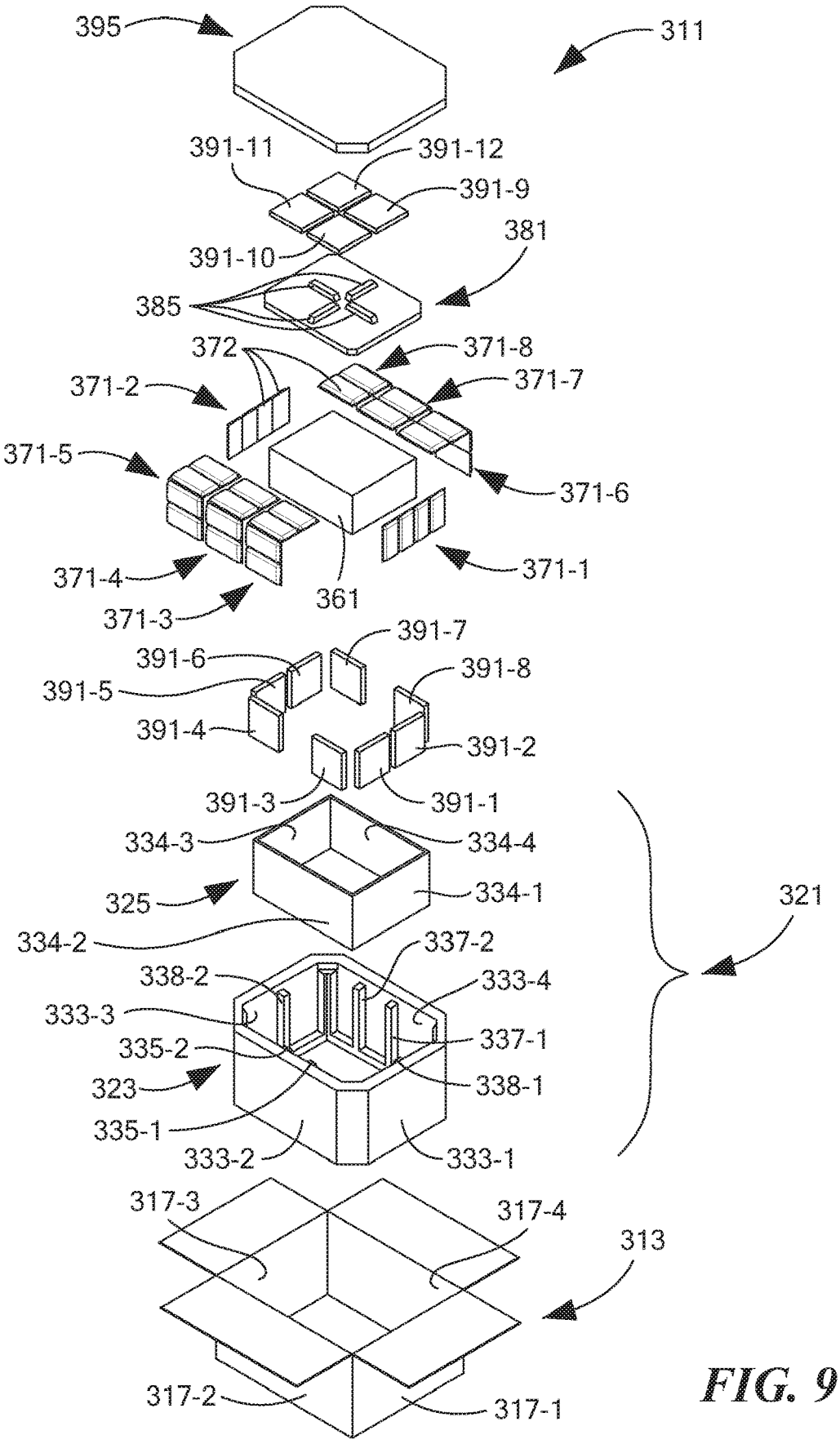
FIG. 9 is a partly exploded perspective view of a fourth embodiment of a shipping system suitable for use in storing and/or transporting temperature-sensitive materials, the shipping system being constructed according to the present invention.

Referring now to FIG. 9, there is shown a partly exploded perspective view of a fourth embodiment of a shipping system suitable for use in storing and/or transporting temperature-sensitive materials, the shipping system being constructed according to the present invention and being represented generally by reference numeral 311. For clarity and/or ease of illustration, certain details of shipping system 311 that are discussed elsewhere in this application or that are not critical to an understanding of the invention may be omitted from FIG. 9 or may be shown therein in a simplified manner.

System 311 may be similar in many respects to system 11 but may be designed for a different payload volume, for example, approximately 34 L, instead of approximately 16 L. System 311 may comprise an outer box 313, a cooler base 321, a product box 361, a first set of temperature-control members 371-1 through 371-8, a foam pad 381, a second set of temperature-control members 391-1 through 391-12, and a lid 395.

Outer box 313 may be similar in construction and composition to outer box 13 of system 11, except that outer box 313 may be dimensioned to accommodate a different payload volume, for example, 34 L, instead of 16L. In the present embodiment, outer box 313 may have four side walls of 317-1 through 317-4, wherein side walls 317-1 and 317-3 may be of generally equal size to one another, wherein side walls 317-2 and 317-4 may be of generally equal size to one another, and wherein side walls 317-2 and 317-4 may be larger than side walls 317-1 and 317-3. Although not shown, handles may be provided on two opposing side walls of outer box 313.

Figure 10:
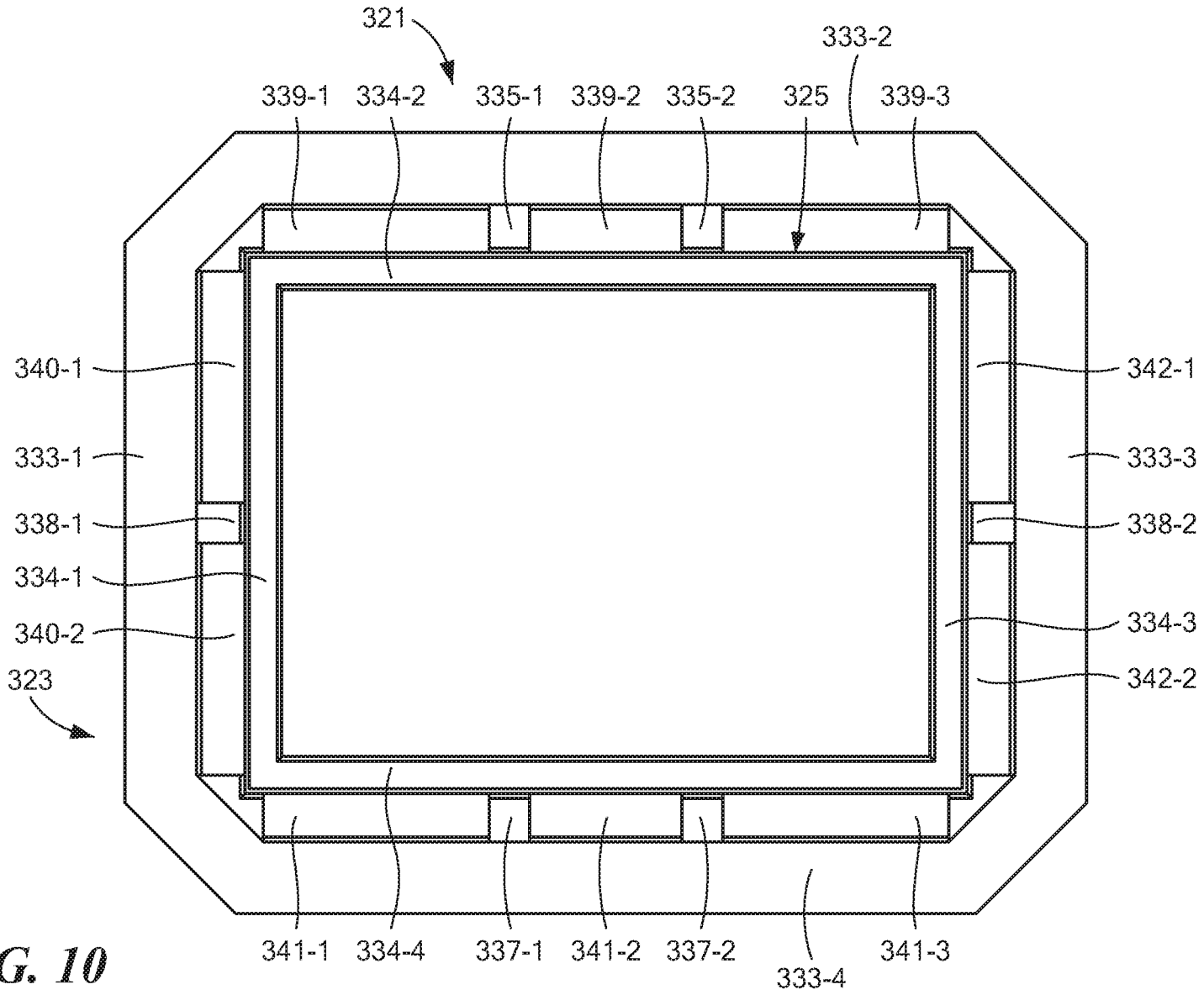
FIG. 10 is a top view of the cooler base shown in FIG. 9.
Figure 11A:
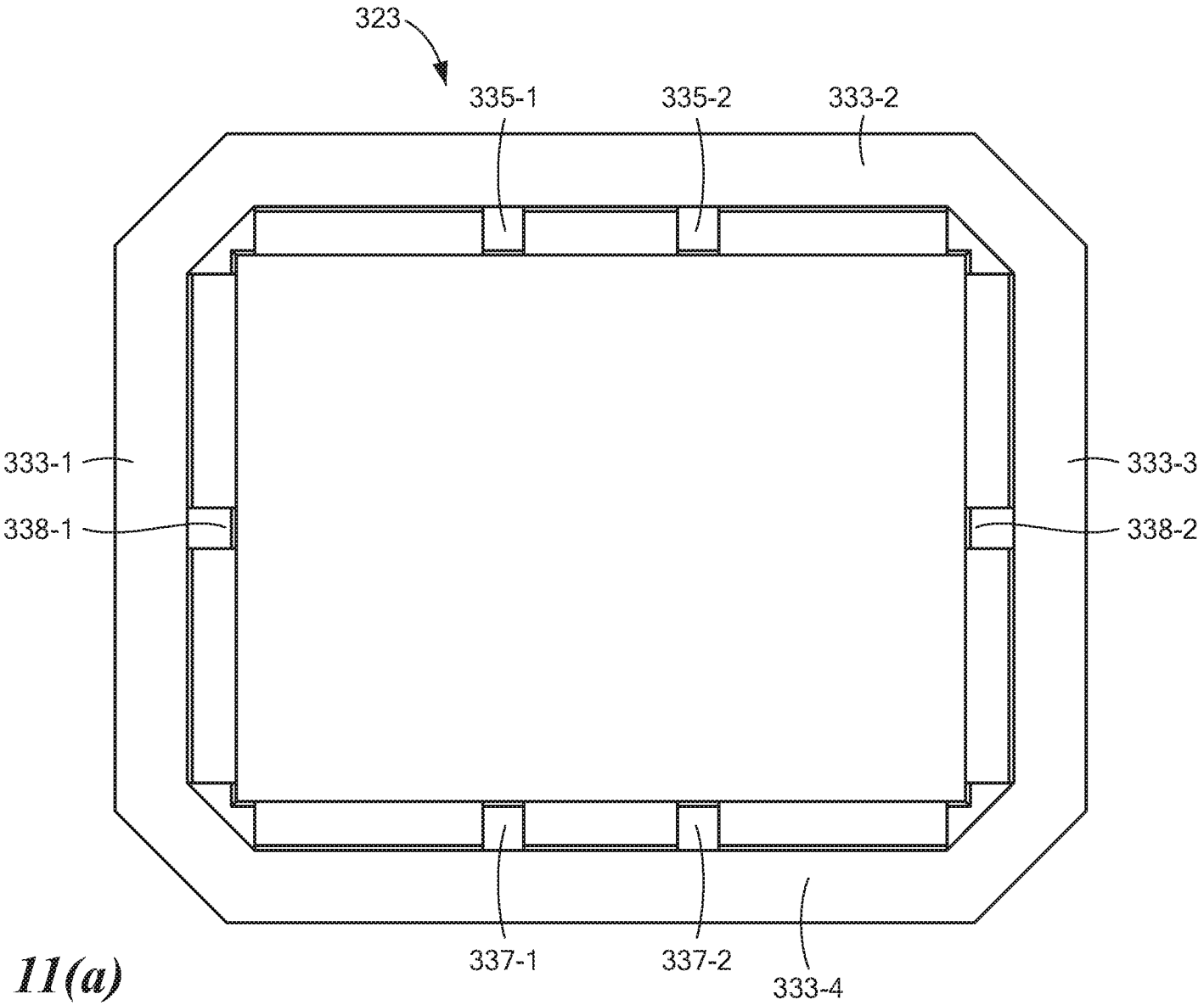
FIG. 11(*a*) through 11(*c*) are top, longitudinal section, and lateral section views, respectively, of the outer portion of the cooler base shown in FIG. 10.
Figure 11B:
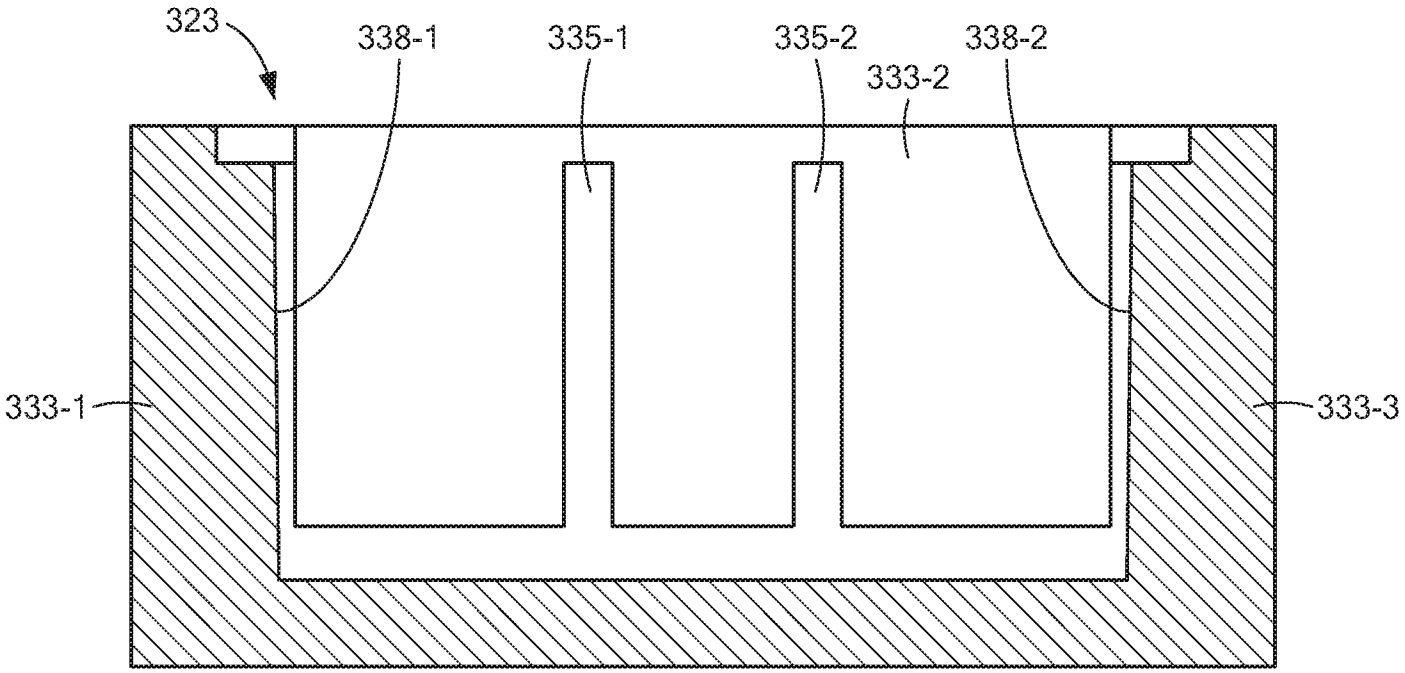
Figure 11C:
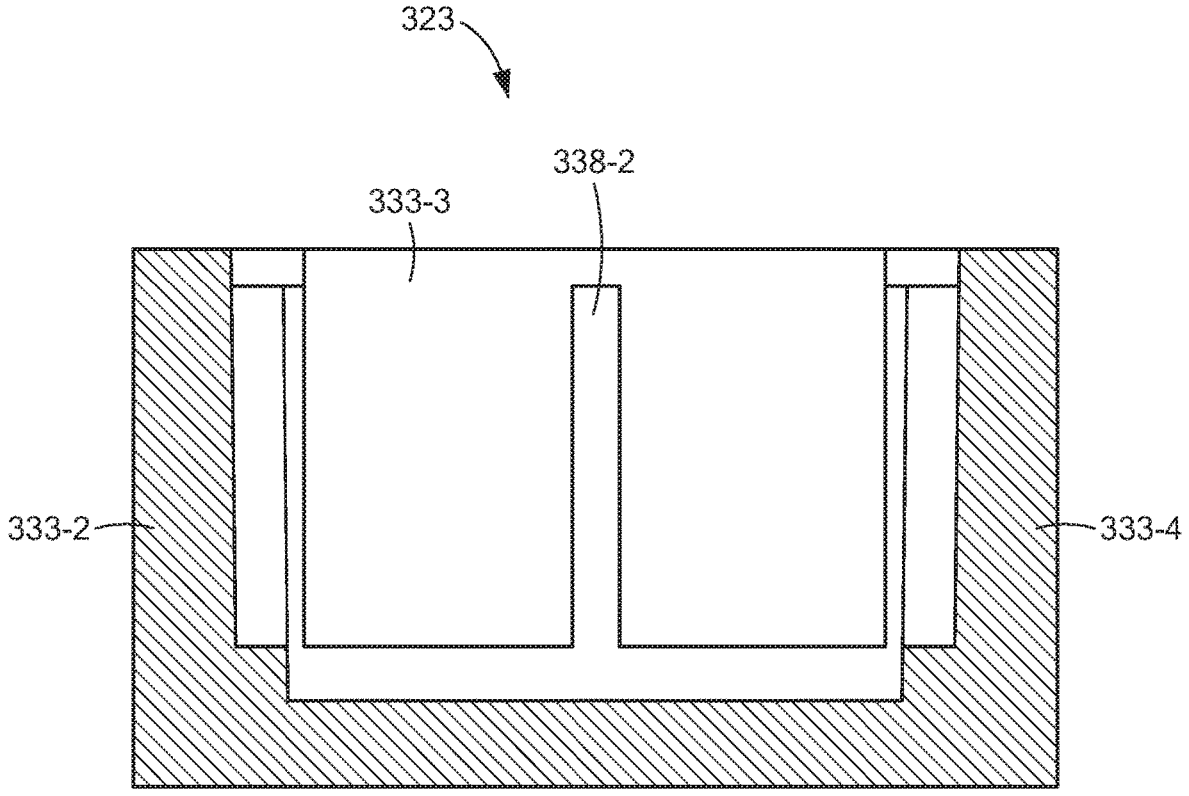
Figure 11D:
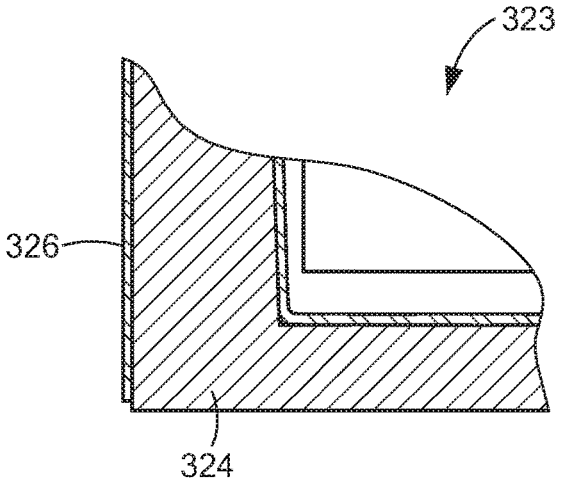
Figure 12A:
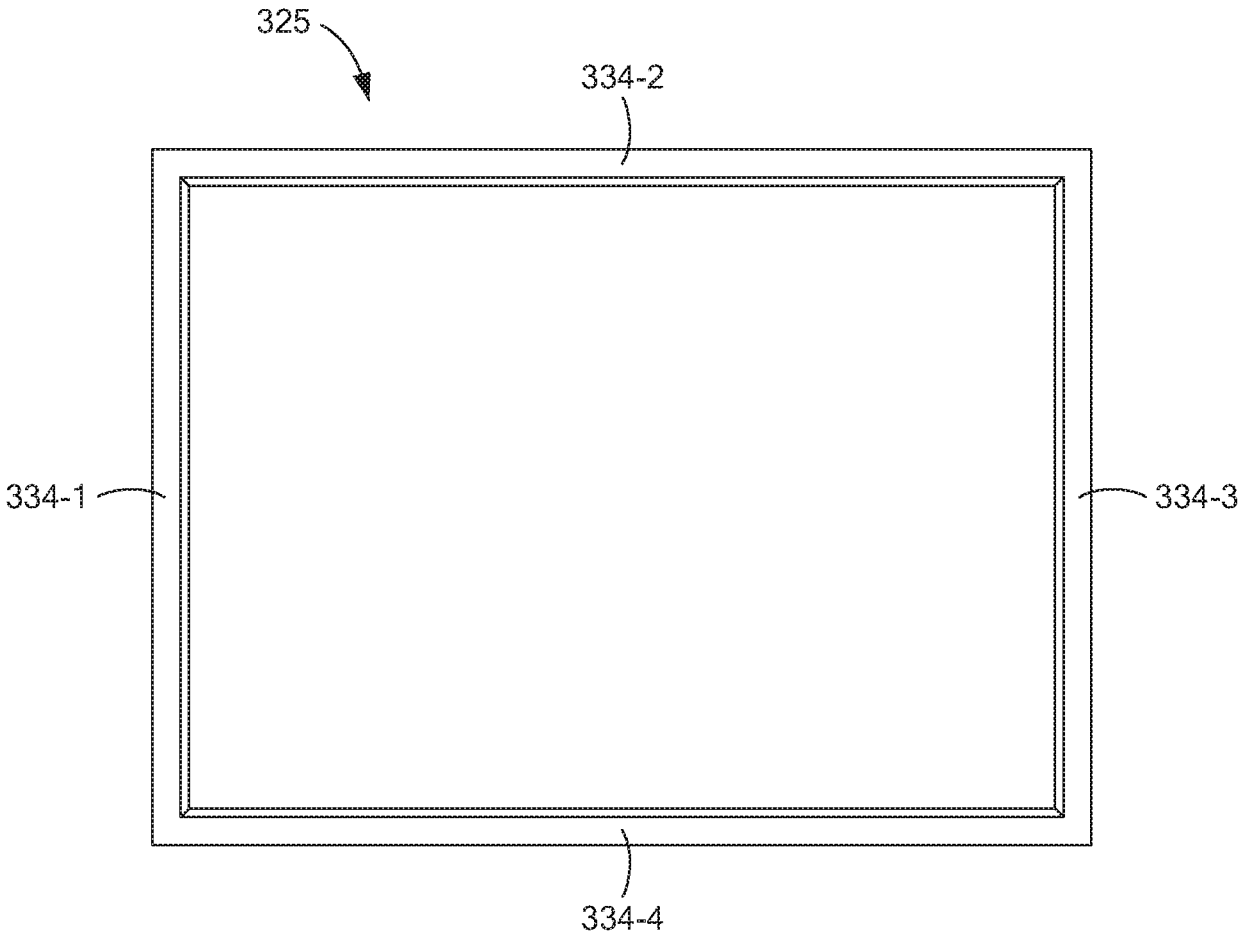
FIGS. 12(*a*) through 12(*c*) are top, longitudinal section, and lateral section views, respectively, of the inner portion of the cooler base shown in FIG. 10.
Figure 12B:
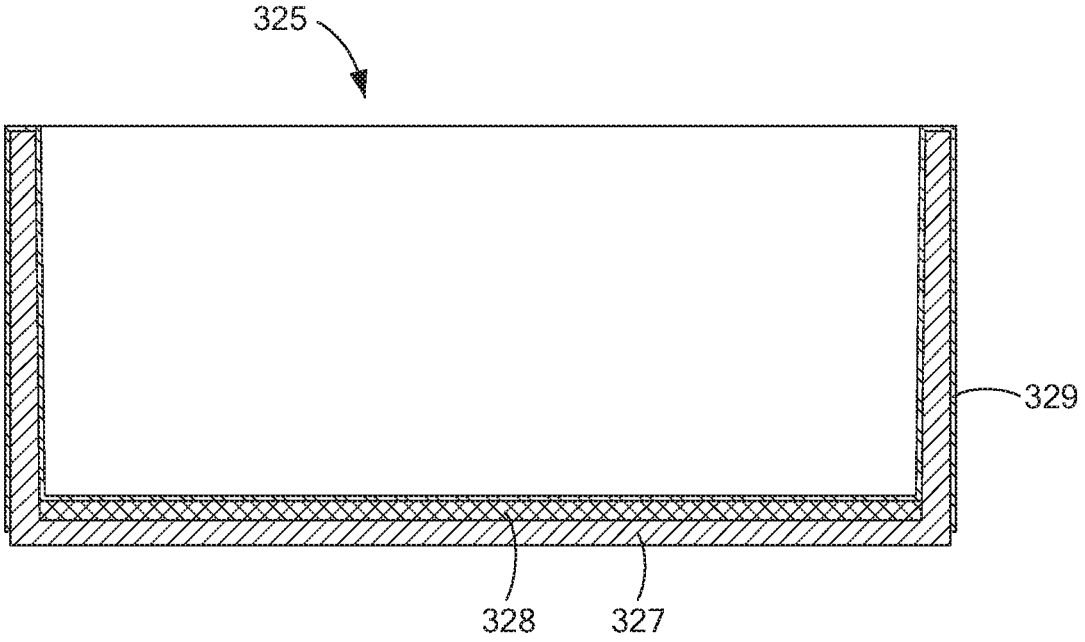
Figure 12C:
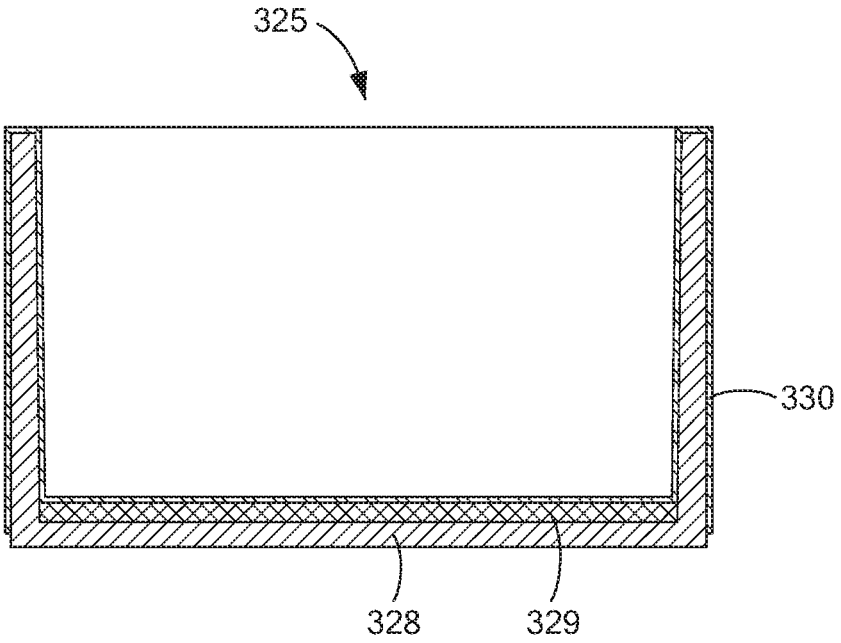

Cooler base 321, which is also shown separately in FIG. 10, may be similar in construction and composition to cooler base 21 of system 11, except that cooler base 321 may comprise an outer portion 323 and an inner portion 325. Outer portion 323, which is also shown separately in FIGS. 11(*a*) through 11(*d*), and inner portion 325, which is also shown separately in FIGS. 12(*a*) through 12(*c*), may be similar to outer portion 23 and inner portion 25, respectively, of system 11, except that inner portion 325 may omit structures corresponding to steps 53-1 and 53-2 of inner portion 25. In addition, outer portion 323 and inner portion 325 may be dimensioned to accommodate a different payload volume, for example, approximately 34 L, instead of approximately 16 L. Outer portion 323, which may comprise a body 324 and a bag 326, may be shaped to comprise four side walls 333-1 through 333-4, wherein side walls 333-2 and 333-4 may have an increased size as compared to side walls 333-1 and 333-3. Inner portion 325, which may comprise a body 327, a heat-spreader 328, and a bag 329, may be shaped to comprise four side walls 334-1 through 334-4, wherein side walls 334-2 and 334-4 may have an increased size as compared to side walls 334-1 and 334-3. A pair of vertical ribs 335-1 and 335-2 may be formed on the interior of side wall 333-2, and a corresponding pair of vertical ribs 337-1 and 337-2 may be formed on the interior of side wall 333-4. In addition, a vertical rib 338-1 may be formed on the interior of side wall 333-1, and a vertical rib 338-2 may be formed on the interior of side wall 333-3. Ribs 335-1 and 335-2 may be appropriately positioned to divide the space between side wall 333-2 of outer portion 323 and side wall 334-2 of inner portion 325 into a plurality of spaces 339-1 through 339-3, and ribs 337-1 and 337-2 may be appropriately positioned to divide the space between side wall 333-4 of outer portion 323 and side wall 334-4 of inner portion 325 into a plurality of spaces 341-1 through 341-3. In a similar fashion, rib 338-1 may be appropriately positioned to divide the space between side wall 333-1 of outer portion 323 and side wall 334-1 of inner portion 325 into a plurality of spaces 340-1 and 340-2, and rib 338-2 may be appropriately positioned to divide the space between side wall 333-3 of outer portion 323 and side wall 334-1 of inner portion 325 into a plurality of spaces 342-1 and 342-2.

Each of spaces 339-1, 339-3, 340-1, 340-2, 341-1, 341-3, 342-1 and 342-2 may be appropriately dimensioned to receive one of temperature-control members 391 while minimizing the amount of space in which such temperature-control members 391 may move laterally therewithin. In other words, ribs 335-1, 335-2, 337-1 and 337-2 may principally serve to divide the spaces between the larger dimensioned side walls of outer portion 323 and inner portion 325 so that two temperature-control members 391 may be snugly received therewithin, and ribs 338-1 and 338-2 may principally serve to divide the spaces between the smaller dimensioned side walls of outer portion 323 and inner portion 325 so that two temperature-control members 391 may be snugly received therewithin. Spaces 339-2 and 341-2 may be unoccupied or may be occupied with thermally-insulating material and/or phase-change material.

Product box 361 may be similar in construction and composition to product box 61 of system 11, except that product box 361 may be dimensioned for a different payload volume, for example, approximately 34 L (e.g., 19 13/16"× 13 13/16"×7 5/8"), instead of approximately 16 L.

First set of temperature-control members 371-1 through 371-8 may be similar in construction and composition to temperature-control members 71-1 through 71-4 of system 11 and may include the same types of modifications discussed above in connection with temperature-control members 71-1 through 71-4 of system 11. Temperature-control members 371-1 and 371-2 may be positioned along the two shorter opposing side faces of product box 361. Two pouches 372 of each of temperature-control members 371-3, 371-4 and 371-5 may be positioned along one of the two longer opposing side faces of product box 361, and the other two pouches of each of temperature-control members 371-3, 371-4 and 371-5 may be positioned along the top of product box 361. Similarly, two pouches 372 of each of temperature-control members 371-6, 371-7 and 371-8 may be positioned along the other of the two longer opposing side faces of product box 361, and the other two pouches of each of temperature-control members 371-6, 371-7 and 371-8 may be positioned along the top of product box 361. For the above reasons, system 311 may comprise eight temperature-control members 371-1 through 371-8 whereas system 11 may comprise four temperature-control members 71-1 through 71-4. The bottoms of temperature-control members 371-1 through 371-8 are preferably positioned directly on top of the portion of bag 329 over heat-spreader 328 so that temperature-control members 371-1 through 371-8 are in thermal contact with heat-spreader 328 through bag 329. Like temperature-control members 71-1 through 71-4, temperature-control members 371-1 through 371-8 may be interchangeably positioned.

Foam pad 381 may be similar in construction and composition to foam pad 81 of system 11, except that foam pad 381 may be dimensioned to accommodate a different payload volume, for example, approximately 34 L, instead of approximately 16 L. In addition, foam pad 381 may comprise a plurality of dividers 385 for separating four temperature-control members, as opposed to a single divider for separating two temperature-control members, as in foam pad 81.

Second set of temperature-control members 391-1 through 391-12 may be identical in construction and composition to temperature-control members 91-1 through 91-8 of system 11 and may include the same types of modifications discussed above in connection with temperature-control members 91-1 through 91-8 of system 11, the only difference being that system 311 may position eight such temperature-control members around the sides of inner portion 325 (as opposed to six such temperature-control members in system 11) and four such temperature-control member over foam pad 381 (as opposed to two such temperature-control members in system 11). Like temperature-control members 91-1 through 91-8, temperature-control members 391-1 through 391-12 may be interchangeably positioned.

Lid 395 may be similar in construction and composition to lid 95 of system 11, except that lid 395 may be dimensioned for cooler base 321.

System 311 may be used in the same manner as system 11. In particular, the same types of phase-change materials employed in system 11 and the same types of pre-conditioning and assembling conditions employed in system 11 may be used in system 311. Accordingly, system 311 may be used, for example, to maintain a payload within a temperature range of +2° C. to +8° C., within a temperature range of +15° C. to +25° C., below −20° C., or at other temperatures for an extended period of time, such as 4 days or longer.

Figure 13:
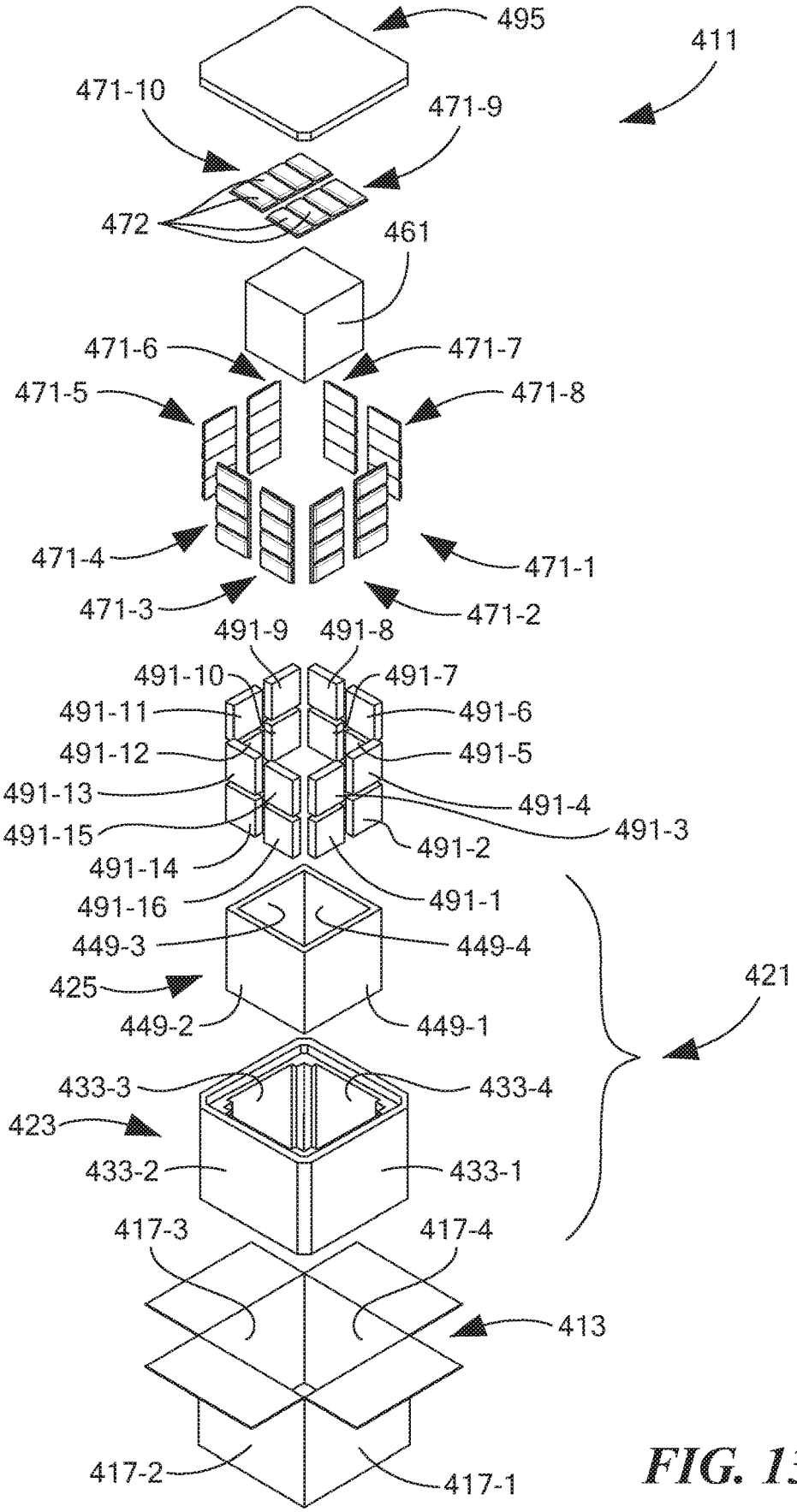
FIG. 13 is a partly exploded perspective view of a fifth embodiment of a shipping system suitable for use in storing and/or transporting temperature-sensitive materials, the shipping system being constructed according to the present invention.

Referring now to FIG. 13, there is shown a partly exploded perspective view of a fifth embodiment of a shipping system suitable for use in storing and/or transporting temperature-sensitive materials, the shipping system being constructed according to the present invention and being represented generally by reference numeral 411. For clarity and/or ease of illustration, certain details of shipping system 411 that are discussed elsewhere in this application or that are not critical to an understanding of the invention may be omitted from FIG. 13 or may be shown therein in a simplified manner.

System 411 may be similar in many respects to system 11 but may be designed for a different payload volume, for example, approximately 43 L, instead of approximately 16 L. System 411 may comprise an outer box 413, a cooler base 421, a product box 461, a first set of temperature-control members 471-1 through 471-10, a second set of temperature-control members 491-1 through 491-16, and a lid 495.

Outer box 413 may be similar in construction and composition to outer box 13 of system 11, except that outer box 413 may be dimensioned to accommodate a different payload volume, for example, approximately 43 L, instead of approximately 16 L. In addition, in the present embodiment, outer box 413 may have four side walls of 417-1 through 417-4 of generally equal size whereas outer box 13 may have two side walls, namely, side walls 17-2 and 17-4 that may be larger than two other side walls, namely, side walls 17-1 and 17-3. Although not shown, handles may be provided on two opposing side walls of outer box 413.

Cooler base 421 may be similar in construction and composition to cooler base 21 of system 11, except that cooler base 421 may comprise an outer portion 423 and an inner portion 425. Outer portion 423 and inner portion 425 may be similar to outer portion 23 and inner portion 25, respectively, of system 11, except that inner portion 425 may omit structures corresponding to steps 53-1 and 53-2 of inner portion 25. In addition, outer portion 423 and inner portion 425 may be dimensioned to accommodate a different payload volume, for example, approximately 43 L, instead of approximately 16 L. Moreover, outer portion 423 may comprise four side walls 433-1 through 433-4 of generally equal size, and inner portion 425 may comprise four side walls 449-1 through 449-4 of generally equal size.

Product box 461 may be similar in construction and composition to product box 61 of system 11, except that product box 461 may be dimensioned for a different payload volume, for example, approximately 43 L (e.g., $13\frac{11}{16}$"×$13\frac{11}{16}$"×$13\frac{13}{16}$"), instead of approximately 16 L.

First set of temperature-control members 471-1 through 471-10 may be similar in construction and composition to temperature-control members 71-1 through 71-4 of system 11 and may include the same types of modifications discussed above in connection with temperature-control members 71-1 through 71-4 of system 11. However, whereas each of temperature-control members 71-1 and 71-2 of system 11 may be positioned along two faces of product box 61, each of temperature-control members 471-1 through 471-8 may be positioned only along a single side face of product box 461, and temperature-control members 471-9 and 471-10 may be positioned only along the top face of product box 461. For the above reasons, system 411 may comprise ten temperature-control members 471-1 through 471-10 whereas system 11 may comprise four temperature-control members 71-1 through 71-4. The bottoms of temperature-control members 471-1 through 471-8 are preferably positioned directly on top of the portion of the bag over the heat-spreader so that temperature-control members 471-1 through 471-8 are in thermal contact with the heat-spreader through the bag. Like temperature-control members 71-1 through 71-4, temperature-control members 471-1 through 471-10 may be interchangeably positioned.

Second set of temperature-control members 491-1 through 491-16 may be identical in construction and composition to temperature-control members 91-1 through 91-8 of system 11 and may include the same types of modifications discussed above in connection with temperature-control members 91-1 through 91-8 of system 11, the only differences being that system 411 may position four such temperature-control members on the outside of each side of inner portion 425 and may omit any such temperature-control members above the payload. For this reason, system 411 may also omit a foam pad over the payload, separating temperature-control members 471 from temperature-control members 491. Like temperature-control members 91-1 through 91-8, temperature-control members 491-1 through 491-16 may be interchangeably positioned.

Figure 14A:
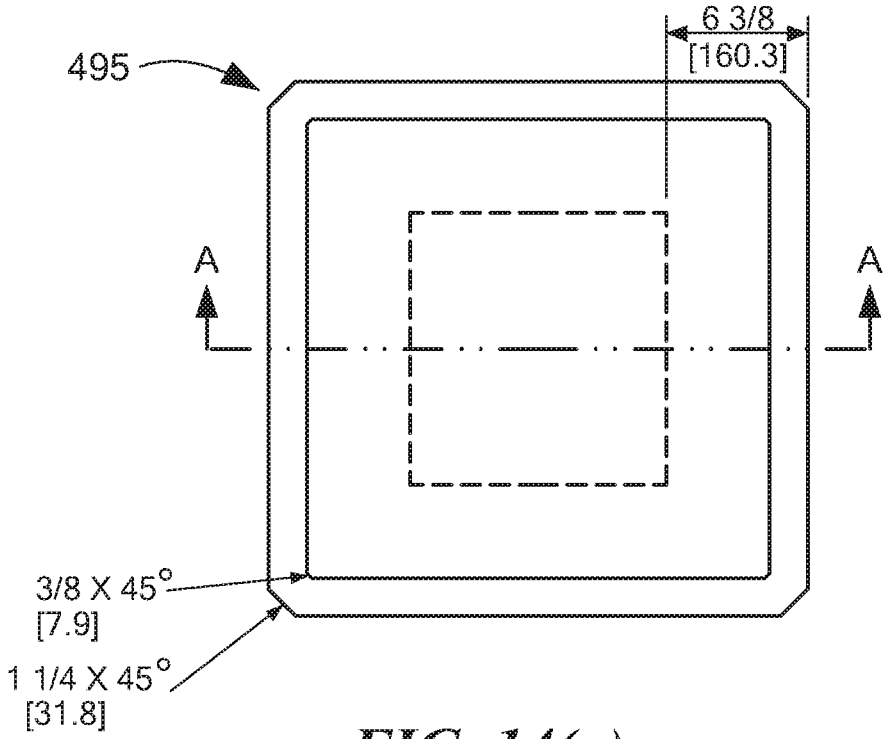
FIGS. 14(*a*) through 14(*c*) are bottom, simplified longitudinal section, and simplified lateral section views, respectively, of the lid shown in FIG. 13.
Figure 14B:
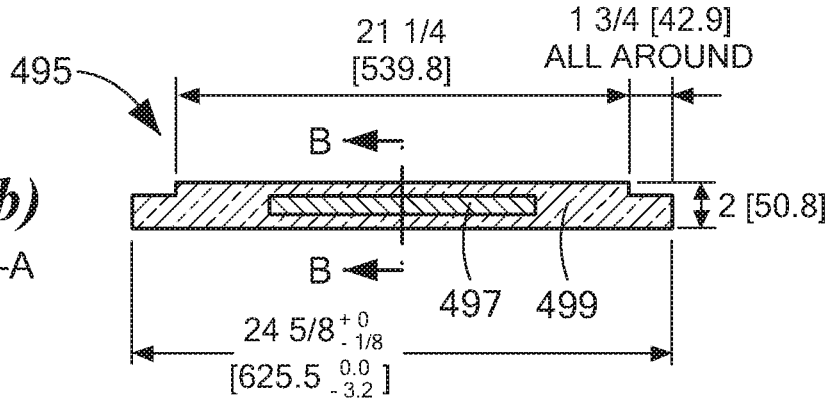
Figure 14C:
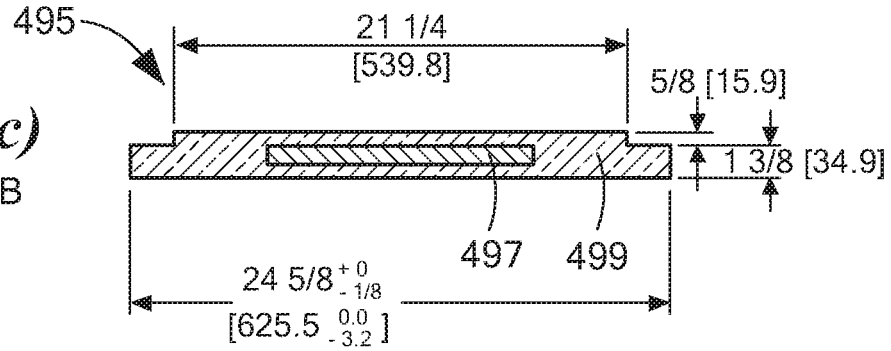

Lid 495, which is also shown separately in FIGS. 14(*a*) through 14(*c*), may be similar in some respects to lid 95 of system 11. One difference between the two lids may be that lid 495 may be dimensioned for cooler base 421. Another difference between the two lids may be that lid 495 may further comprise a vacuum insulation panel (VIP) 497, which may be conventional, embedded within a body 499 of foamed polyurethane material or the like. (As in the case of lid 95, lid 495 may further comprise a thin, flexible, non-self-supporting, unfoamed polymer bag (not shown), which may encase body 499, except for the exterior top surface of body 499 (and, perhaps, a small portion of the adjacent exterior side surfaces of body 499).) Lid 495 may be made by a technique similar to that disclosed in U.S. Pat. No. 6,868,982, except that, after a portion of the mold has been filled with the foamed polyurethane material used to form body 499, VIP 497 may be placed on top of the foamed polyurethane material partially filling the mold, and the remainder of the mold may be filled with additional foamed polyurethane material, thereby encapsulating VIP 497 within the foamed polyurethane material.

It is to be understood that, instead of embedding a vacuum insulation panel in polyurethane foam, other combinations of thermal insulation materials may be used to form lid 495.

Illustrative dimensions (in inches) for lid 495 are provided in FIGS. 14(*a*) through 14(*c*). These dimensions, like all dimensions in the present application, are provided solely for purposes of example and are not to be considered as limiting.

System 411 may be used in the same manner as system 11. In particular, the same types of phase-change materials employed in system 11 and the same types of pre-conditioning and assembling conditions employed in system 11 may be used in system 411. Accordingly, system 411 may be used, for example, to maintain a payload within a temperature range of +2° C. to +8° C., within a temperature range of +15° C. to +25° C., below −20° C., or at other temperatures for an extended period of time, such as 4 days or longer.

Figure 15:
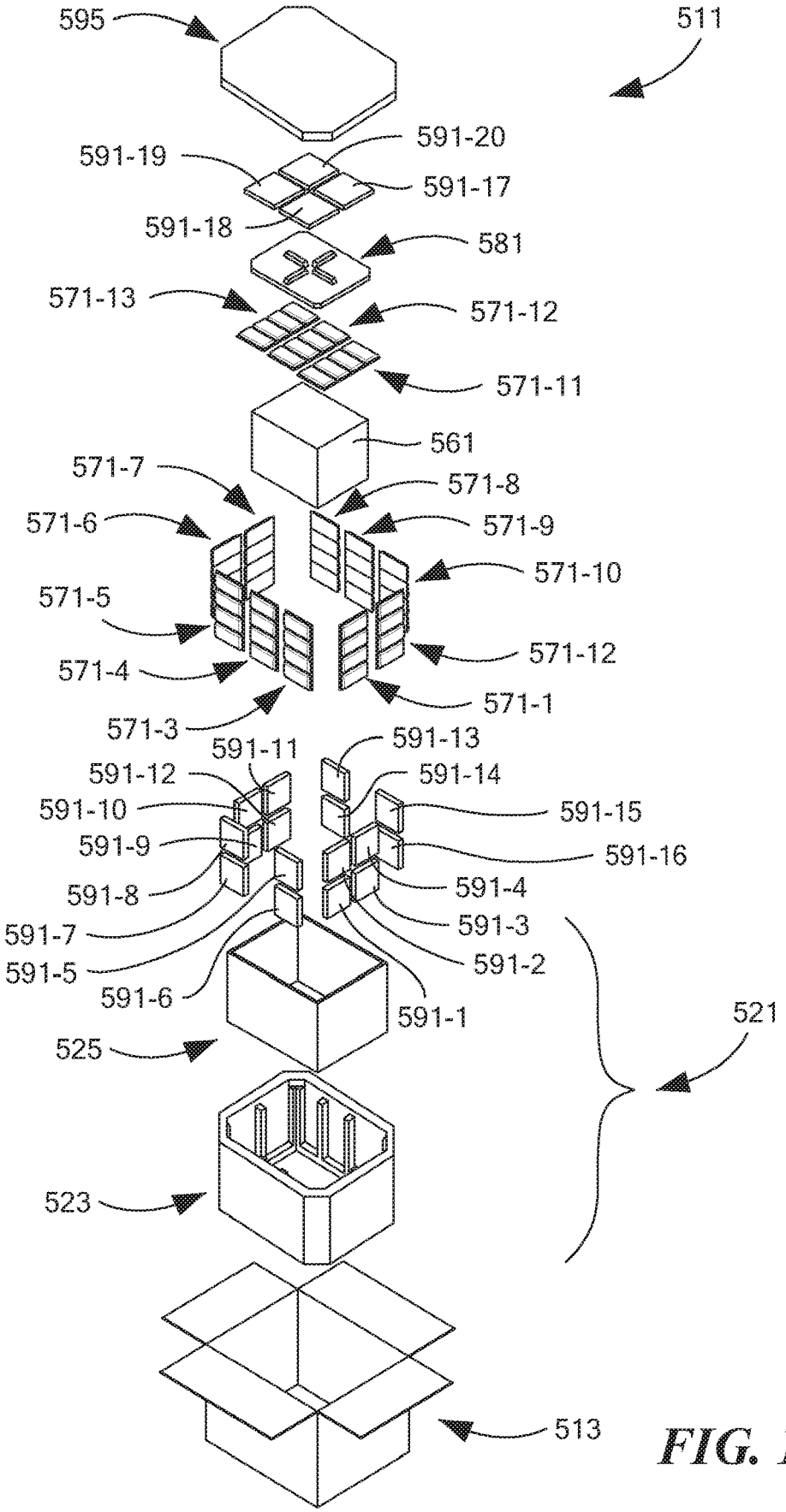
FIG. 15 is a partly exploded perspective view of a sixth embodiment of a shipping system suitable for use in storing and/or transporting temperature-sensitive materials, the shipping system being constructed according to the present invention.

Referring now to FIG. 15, there is shown a partly exploded perspective view of a sixth embodiment of a shipping system suitable for use in storing and/or transporting temperature-sensitive materials, the shipping system being constructed according to the present invention and being represented generally by reference numeral 511. For clarity and/or ease of illustration, certain details of shipping system 511 that are discussed elsewhere in this application or that are not critical to an understanding of the invention may be omitted from FIG. 15 or may be shown therein in a simplified manner.

System 511 may be similar in many respects to system 311 but may be designed for a different payload volume, for example, approximately 66 L, instead of approximately 34 L. System 511 may comprise an outer box 513, a cooler base 521, a product box 561, a first set of temperature-control members 571-1 through 571-13, a foam pad 581, a second set of temperature-control members 591-1 through 591-20, and a lid 595.

Outer box 513 may be similar in construction and composition to outer box 313 of system 311, except that outer box 513 may be dimensioned to accommodate a different payload volume, for example, approximately 66 L, instead of approximately 34 L. Although not shown, handles may be provided on two opposing side walls of outer box 513.

Cooler base 521 may be similar in construction and composition to cooler base 321 of system 311, except that cooler base 521 may comprise an outer portion 523 and an inner portion 525. Outer portion 523 and inner portion 525 may be similar to outer portion 323 and inner portion 325, respectively, of system 311, except that outer portion 523 and inner portion 525 may be dimensioned to accommodate a different payload volume, for example, approximately 66 L, instead of approximately 34 L.

Product box 561 may be similar in construction and composition to product box 361 of system 311, except that product box 561 may be dimensioned for a different payload volume, for example, approximately 66 L (e.g., 19 13/16"× 13 13/16"×14 5/8"), instead of approximately 34 L.

First set of temperature-control members 571-1 through 571-13 may be similar in construction and composition to temperature-control members 371-1 through 371-12 of system 311 and may include the same types of modifications discussed above in connection with temperature-control members 371-1 through 371-12 of system 311. Each of temperature-control members 571-1 through 571-10 may be positioned only along a single side face of product box 561 (with three such temperature-control members 571 positioned along each of the opposing larger side faces of product box 561 and with two such temperature-control members 571 positioned along each of the opposing smaller side faces of product box 561), and each of temperature-control members 571-11 through 571-13 may be positioned only along the top face of product box 561. For the above reasons, system 511 may comprise thirteen temperature-control members 571-1 through 571-13. The bottoms of temperature-control members 571-1 through 571-10 are preferably positioned directly on top of the portion of the bag over the heat-spreader so that temperature-control members 571-1 through 571-10 are in thermal contact with the heat-spreader through the bag. Like temperature-control members 71-1 through 71-4, temperature-control members 571-1 through 571-13 may be interchangeably positioned.

Foam pad 581 may be similar in construction and composition to foam pad 381 of system 311, except that foam pad 581 may be dimensioned to accommodate a different payload volume, for example, approximately 66 L, instead of approximately 34 L.

Second set of temperature-control members 591-1 through 591-20 may be identical in construction and composition to temperature-control members 391-1 through 391-12 of system 311 and may include the same types of modifications discussed above in connection with temperature-control members 391-1 through 391-12 of system 311. In system 511, four such temperature-control members may be positioned on each side of inner portion 525 and four such temperature-control members may be positioned on top of pad 581. Like temperature-control members 91-1 through 91-8, temperature-control members 591-1 through 591-20 may be interchangeably positioned.

Lid 595 may be similar in construction and composition to lid 395 of system 311, except that lid 595 may be dimensioned for cooler base 521.

System 511 may be used in the same manner as system 11. In particular, the same types of phase-change materials employed in system 11 and the same types of pre-conditioning and assembling conditions employed in system 11 may be used in system 511. Accordingly, system 511 may be used, for example, to maintain a payload within a temperature range of +2° C. to +8° C., within a temperature range of +15° C. to +25° C., below −20° C., or at other temperatures for an extended period of time, such as 4 days or longer.

Many of the systems described herein may use identical types of temperature-control members to keep payloads within a particular temperature range. For example, temperature-control members 71-1 through 71-4 of system 11, temperature-control members 271-1 through 271-6 of system 211, temperature-control members 371-1 through 371-8 of system 311, temperature-control members 471-1 through 471-10 of system 411, and temperature-control members 571-1 through 571-13 of system 511 may be identical across systems for a given temperature range, the only difference being the number of such temperature-control members used by these systems and the arrangement of such temperature-control members within the respective systems. Similarly, temperature-control members 91-1 through 91-8 of system 11, temperature-control members 191-1 through 191-5 of system 111, temperature-control members 291-1 through 291-12 of system 211, temperature-control members 391-1 through 391-12 of system 311, temperature-control members 491-1 through 491-16 of system 411, and temperature-control members 591-1 through 591-20 of system 511 may be identical across systems, the only difference being the number of such temperature-control members used by these systems and the arrangement of such temperature-control members within the respective systems. As a result, a party may keep inventories of various types of temperature-control members designed for keeping payloads within particular temperature ranges and then may use these temperature-control members, as needed, within the various systems. This is advantageous as it reduces the number of different types of temperature-control members that may be needed by a party using differently-sized systems.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A shipping system for use in transporting and/or storing temperature-sensitive materials, the shipping system comprising:

(a) a cooler base, the cooler base comprising (i) an inner portion, the inner portion comprising A. a thermal insulation unit, the thermal insulation unit comprising a bottom wall and four side walls, the bottom wall and the four side walls collectively defining a chamber, B. a thermally-conductive member, the thermally-conductive member being disposed within the chamber and over at least a portion of the bottom wall of the thermal insulation unit, and C. a first polymeric bag, the first polymeric bag conformingly disposed over the thermally-conductive member and at least a portion of the thermal insulation unit, (ii) an outer portion, the outer portion comprising thermally-insulating material and defining an opening, wherein the inner portion is disposed within the opening of the outer portion and wherein the inner portion and the outer portion collectively define a plurality of cavities therebetween;

(b) a product box, the product box disposed within the inner portion of the cooler base, the product box being in direct contact with the first polymeric bag and being positioned over a first portion of the thermally-conductive member;

(c) a first set of temperature-control members, the first set of temperature-control members being disposed within the inner portion of the cooler base, wherein at least one of the first set of temperature-control members is in direct contact with the first polymer bag, is positioned over a second portion of the thermally-conductive member, and is in thermal contact with the thermally-conductive member, and wherein none of the first set of temperature-control members is positioned under the product box; and (d) a second set of temperature-control members, wherein at least one of the second set of temperature-control members is disposed within the cavities.

2. The shipping system as claimed in claim 1 wherein the payload box is a six-sided structure comprising a top, a bottom, and four sides, wherein the first set of temperature-control members comprises a plurality of temperature-control members, and wherein the plurality of temperature-control members collectively cover at least a portion of the top of the payload box and at least a portion of each of the four sides of the payload box.

3. The shipping system as claimed in claim 1 wherein the first set of temperature-control members comprises a plurality of temperature-control members and wherein the plurality of temperature-control members of the first set of temperature-control members collectively comprise no more than one type of phase-change material.

4. The shipping system as claimed in claim 1 wherein the first set of temperature-control members comprises a plurality of temperature-control members and wherein the plurality of temperature-control members of the first set of temperature-control members collectively comprise more than one type of phase-change material.

5. The shipping system as claimed in claim 1 wherein the first set of temperature-control members comprises a plurality of temperature-control members and wherein each of the plurality of temperature-control members comprises a water-based phase-change material.

6. The shipping system as claimed in claim 1 wherein the first set of temperature-control members comprises a plurality of temperature-control members and wherein each of the plurality of temperature-control members comprises an organic phase-change material.

7. The shipping system as claimed in claim 6 wherein the organic phase-change material comprises a gelled organic phase-change material comprising at least one n-alkane.

8. The shipping system as claimed in claim 1 wherein the first set of temperature-control members comprises a plurality of temperature-control members and wherein the plurality of temperature-control members of the first set of temperature-control members are identical in size, shape and composition and are adapted to be interchangeably positioned with one another.

9. The shipping system as claimed in claim 1 wherein the first set of temperature-control members comprises a plurality of temperature-control members and wherein each of the plurality of temperature-control members of the first set of temperature-control members comprises a phase-change material having a phase-change temperature in the range of +2° C. to +8° C.

10. The shipping system as claimed in claim 1 wherein the first set of temperature-control members comprises a plurality of temperature-control members and wherein each of the plurality of temperature-control members of the first set of temperature-control members comprises a phase-change material having a phase-change temperature in the range of +15° C. to +25° C.

11. The shipping system as claimed in claim 1 wherein the first set of temperature-control members comprises a first phase-change material and wherein the second set of temperature-control members comprises a second phase-change material and wherein the first phase-change material and the second phase-change material are different from one another in composition.

12. The shipping system as claimed in claim 11 wherein the second set of temperature-control members comprises a plurality of temperature-control members and wherein the plurality of temperature-control members of the second set of temperature-control members are identical in size, shape and composition and are adapted to be interchangeably positioned with one another.

13. The shipping system as claimed in claim 1 wherein the inner portion of the cooler base is fixedly mounted within the outer portion of the cooler base.

14. The shipping system as claimed in claim 13 wherein the inner portion of the cooler base is permanently bonded with an adhesive to the outer portion of the cooler base.

15. The shipping system as claimed in claim 14 wherein the outer portion of the cooler base comprises a bottom wall and four side walls, wherein the bottom wall of the outer portion of the cooler base comprises a recessed area, and wherein the recessed area is dimensioned to matingly receive the inner portion of the cooler base.

16. The shipping system as claimed in claim 1 wherein the outer portion of the cooler base further comprises four corner posts for use in defining the cavities between the inner portion and the outer portion.

17. The shipping system as claimed in claim 16 wherein the outer portion of the cooler base further comprises at least one vertical rib for use in defining the cavities between the inner portion and the outer portion.

18. The shipping system as claimed in claim 1 wherein the thermally-insulating material of the outer portion of the cooler base comprises a body of foamed polyurethane and wherein the outer portion of the cooler base further comprises a second polymeric bag, the second polymeric bag conformingly disposed over the body of foamed polyurethane.

19. The shipping system as claimed in claim 1 wherein the thermal insulation unit of the inner portion of the cooler base further comprises a pair of steps disposed at opposite ends of the bottom wall and wherein the thermally-conductive member is disposed between the pair of steps.

20. The shipping system as claimed in claim 1 wherein the thermally-conductive member comprises an aluminum sheet having a thickness of about 10 mil.

21. The shipping system as claimed in claim 1 further comprising a cooler lid, the cooler lid being mounted on the cooler base to selectively permit access to contents of the cooler base.

22. The shipping system as claimed in claim 21 wherein the cooler lid comprises a plurality of different thermal insulation materials.

23. The shipping system as claimed in claim 22 wherein the cooler lid comprises a vacuum insulation panel embedded within foamed polyurethane.

24. The shipping system as claimed in claim 1 wherein the first set of temperature-control members comprises at least one temperature-control member positioned over the product box and wherein the second set of temperature-control members comprises at least one temperature-control member positioned over the product box and over the at least one temperature-control member of the first set of temperature-control members positioned over the product box, the shipping system further comprising a foam pad divider positioned over the product box, the foam pad divider being positioned between the at least one temperature-control member of the first set of temperature-control members positioned over the product box and the at least one temperature-control member of the second set of temperature-control members positioned over the product box.

25. The shipping system as claimed in claim 1 wherein the first set of temperature-control members comprises a first plurality of temperature-control members, wherein the second set of temperature-control members comprises a second plurality of temperature-control members, wherein each of the first plurality of temperature-control members comprises a first phase-change material, wherein each of the second plurality of temperature-control members comprises a second phase-change material and wherein the first phase-change material and the second phase-change material have different phase-change temperatures.

26. The shipping system as claimed in claim 1 wherein the first set of temperature-control members comprises a first plurality of temperature-control members, wherein the second set of temperature-control members comprises a second plurality of temperature-control members, and wherein the first plurality of temperature-control members and the second plurality of temperature-control members are preconditioned at different temperatures.

27. The shipping system as claimed in claim 1 wherein the first set of temperature-control members comprises a first plurality of temperature-control members, wherein the second set of temperature-control members comprises a second plurality of temperature-control members, and wherein the first plurality of temperature-control members and the second plurality of temperature-control members are preconditioned at the same temperature.

28. A shipper for use in a shipping system for transporting and/or storing temperature-sensitive materials, the shipper comprising: (a) a cooler base, the cooler base comprising (i) an inner portion, the inner portion comprising a thermal insulation unit, the thermal insulation unit comprising a bottom wall and four side walls, the bottom wall and the four side walls collectively defining a chamber, (ii) an outer portion, the outer portion comprising thermally-insulating material and defining an opening, wherein the inner portion is disposed within the opening of the outer portion and is permanently bonded to the outer portion, and wherein the inner portion and the outer portion collectively define a plurality of cavities therebetween; wherein the inner portion of the cooler base further comprises a thermally-conductive member and a first polymeric bag, the thermally-conductive member being disposed over at least a portion of the bottom wall of the thermal insulation unit, the first polymeric bag conformingly disposed over the thermally-conductive member and at least a portion of the thermal insulation unit; (b) a product box, the product box disposed within the inner portion of the cooler base and seated on the bottom wall of the inner portion, the product box having a plurality of faces; and (c) a cooler lid, the cooler lid being mounted on the cooler base to selectively permit access to contents of the cooler base.

29. A shipping system, the shipping system comprising the shipper of claim 28 and dry ice, the dry ice being disposed in the chamber of the inner portion on top of and around the product box, but not below the product box, and also being disposed in the cavities between the inner portion and the outer portion.

30. A kit, the kit comprising the shipper of claim 28, a first set of temperature-control members comprising a first phase-change material, a second set of temperature-control members comprising a second phase-change material, and a third set of temperature-control members comprising a third phase-change material, the second phase-change material being different in composition than the first phase-change material, the third phase-change material being different in composition than the first and second phase-change materials, the first and third sets of temperature-control members being alternatively positionable in the chamber of the inner portion of the cooler base, the second set of temperature-control members being positionable in the cavities between the inner portion and the outer portion.

31. A kit, the kit comprising a plurality of the shippers of claim 28, wherein at least a first shipper of the plurality of shippers is dimensioned for a different payload volume than a second shipper of the plurality of shippers, a first set of temperature-control members comprising a first phase-change material and a second set of temperature-control members comprising a second phase-change material, the first set of temperature-control members being alternatively positionable in the chamber of the inner portion of the cooler base of the first shipper and in the chamber of the inner portion of the cooler base of the second shipper, the second set of temperature-control members being alternatively positionable in the cavities between the inner portion and the outer portion of the cooler base of the first shipper and in the cavities between the inner portion and the outer portion of the cooler base of the second shipper.

32. A method of transporting and/or storing temperature-sensitive materials, the method comprising the steps of:

(a) providing the shipper of claim 28;

(b) providing a first set of temperature-control members and a second set of temperature-control members, the first set of temperature-control members being positionable in the chamber of the inner portion of the cooler base, the second set of temperature-control members being positionable in the cavities between the inner portion and the outer portion;

(c) transporting the shipper, the first set of temperature-control members and the second set of temperature-control members from a first location to a second location;

(d) preconditioning the first set of temperature-control members and the second set of temperature-control members;

(e) installing the first set of temperature-control members and the second set of temperature-control members in the shipper; and (f) loading a payload into the product box.

33. The method as claimed in claim 32 wherein the transporting step comprises transporting the first set of temperature-control members and the second set of temperature-control members outside of the shipper.

34. The method as claimed in claim 32 wherein the transporting step comprises transporting the first set of temperature-control members and the second set of temperature-control members in the shipper.

35. The method as claimed in claim 32 wherein the preconditioning step is performed before the installing step.

36. A method of making a shipper for use in transporting and/or storing temperature-sensitive materials, the method comprising the steps of, (a) fabricating an inner portion of a cooler base, the inner portion comprising a thermal insulation unit, the thermal insulation unit comprising a bottom wall and four side walls, the bottom wall and the four side walls collectively, defining a chamber, wherein the inner portion of the cooler base further comprises a thermally-conductive member and a first polymeric bag, the thermally-conductive member being disposed over at least a portion of the bottom wall of the thermal insulation unit, the first polymeric bag conformingly disposed over the thermally-conductive member and at least a portion of the thermal insulation unit; (b) fabricating an outer portion of a cooler base, the outer portion comprising thermally-insulating material and defining an opening; (c) positioning the inner portion of the cooler base within the opening of the outer portion of the cooler base and permanently bonding the inner portion of the cooler base to the outer portion of the cooler base, whereby a cooler base is formed in which the inner portion and the outer portion collectively define a plurality of cavities therebetween; (d) positioning a cooler lid on the cooler base to selectively permit access to contents of the cooler base.

* * * * *